US007299189B1

(12) United States Patent
Sato

(10) Patent No.: US 7,299,189 B1
(45) Date of Patent: Nov. 20, 2007

(54) ADDITIONAL INFORMATION EMBEDDING METHOD AND IT'S DEVICE, AND ADDITIONAL INFORMATION DECODING METHOD AND ITS DECODING DEVICE

(75) Inventor: Hideo Sato, Tokyo (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 09/700,611

(22) PCT Filed: Mar. 21, 2000

(86) PCT No.: PCT/JP00/01715

§ 371 (c)(1),
(2), (4) Date: Feb. 5, 2001

(87) PCT Pub. No.: WO00/57399

PCT Pub. Date: Sep. 28, 2000

(30) Foreign Application Priority Data

Mar. 19, 1999 (JP) ..... 11-076944

(51) Int. Cl.
*G10L 19/00* (2006.01)

(52) U.S. Cl. ..... 704/500

(58) Field of Classification Search ..... 704/500–504, 704/200.1; 382/100, 248, 250, 251; 713/176
See application file for complete search history.

(56) References Cited

U.S. PATENT DOCUMENTS 4,750,173 A 6/1988 Bliithgen
6,061,793 A * 5/2000 Tewfik et al. ..... 713/176
6,208,735 B1 * 3/2001 Cox et al. ..... 380/54
6,240,121 B1 * 5/2001 Senoh ..... 375/130
6,359,849 B1 * 3/2002 Sato et al. ..... 369/59.1
6,738,493 B1 * 5/2004 Cox et al. ..... 382/100

FOREIGN PATENT DOCUMENTS

| | | |
|---|---|---|
| EP | 0 673 014 | 9/1995 |
| EP | 0 766 468 | 4/1997 |
| EP | 0 840 513 | 5/1998 |
| EP | 0 891 071 | 1/1999 |
| EP | 0 901 259 | 3/1999 |
| JP | 6-232824 | 8/1994 |

(Continued)

OTHER PUBLICATIONS

Database Inspec Online! The Institution of Electrical Engineers, Stevenage, GB; Sep. 1998, Iwakiri M et al: "Digital watermark scheme for high quality audio data by spectrum spreading and modified discrete cosine transform" XP002331466 Database accession No. 6102486 & Transactions of the Information Processing Society of Japan Inf. Process. Soc. Japan , vol. 39, No. 9, Sep. 1998, pp. 2631-2637 ISSN: 0387-5806.

*Primary Examiner*—Angela Armstrong
(74) *Attorney, Agent, or Firm*—Finnegan, Henderson, Farabow, Garrett & Dunner, L.L.P.

(57) ABSTRACT

The present invention relates to an additional information embedding method for embedding additional information into an audio signal, in which the audio signal is MDCT-transformed to calculate an MDCT coefficient and the calculated MDCT coefficient is damped, shifted in the direction of the frequency axis and added to the original MDCT coefficient, thereby embedding the additional information as a watermark into the audio signal.

67 Claims, 25 Drawing Sheets

FOREIGN PATENT DOCUMENTS

| | | |
|---|---|---|
| JP | 6232824 | 8/1994 |
| JP | 7-115369 | 5/1995 |
| JP | 7115369 | 5/1995 |
| JP | 7-297725 | 11/1995 |
| JP | 7297725 | 11/1995 |
| JP | 8-44399 | 2/1996 |
| WO | WO 94 18762 | 8/1994 |
| WO | WO 95 26601 | 10/1995 |

* cited by examiner

ADDITIONAL INFORMATION EMBEDDING METHOD AND IT'S DEVICE, AND ADDITIONAL INFORMATION DECODING METHOD AND ITS DECODING DEVICE

TECHNICAL FIELD

This invention relates to an additional information embedding method and device for embedding, into an audio signal, information which enables limitation of recording of the audio signal, prohibition of transfer to another equipment or protection of the interest of the copyright holder, as additional information, and a demodulation method and device for demodulating the additional information added to the audio signal.

BACKGROUND ART

There has been conventionally used a technique for embedding, as additional information, information which prohibits transfer of an audio signal to another equipment or which limits recording of the audio signal in order to realize protection of the contents of an audio work. The additional information of this type is embedded into an audio signal as a watermark, which may be a digital watermark or an analog watermark.

As a technique for embedding a digital watermark into a digital audio signal, there is employed a technique which uses the least significant bit (LSB) of a 16-bit PCM audio signal for watermark data. Also, there is employed a technique for embedding additional information into a digital audio signal as a watermark by operating the modified discrete cosine transform (MDCT) coefficient of a compression-coded digital audio signal or the coefficient of a subband.

Since a digital watermark can be read and written by superimposing watermark data directly on a digital audio signal, signal processing is facilitated. However, the digital watermark will be broken when the digital audio signal is demodulated to an analog audio signal. The digital watermark might also be broken when the digital audio signal is converted to a different data format. Therefore, the digital watermark cannot limit repeated recording of the analog audio signal, that is, copying of the analog audio signal, and cannot sufficiently protect the interest of the copyright holder of the audio work.

An analog watermark is embedded into a digital audio signal in such a manner that it is detected in the form of an analog signal. Even after conversion of the file format is carried out, the watermark can be read again by demodulating the digital audio signal to an analog audio signal.

Meanwhile, a technique for distributing an audio work such as a music tune to the user through a communication network is proposed. This distribution technique is exemplified by the electronic music distribution (EMD) for transmitting and recording a digital audio signal in a compressed data format. An analog watermark which is embedded in the compressed digital audio signal distributed by the EMD cannot be read out or written unless the compressed digital audio signal is demodulated to a PCM signal or an analog signal. Therefore, in order to record the audio signal distributed by the EMD on which the analog watermark is superimposed, the user needs to demodulate the audio signal to a PCM signal. As the compressed digital audio signal is demodulated to a PCM signal or the like, the data size is increased and recording to a recording medium cannot be carried out efficiently. Also, in order to rewrite the analog watermark, the audio signal distribution side needs to demodulate audio signal once compressed to a PCM signal and therefore cannot rewrite the analog watermark easily.

As methods for embedding an analog watermark into an audio signal, a spread spectrum system and a phase shift keying (PSK) system are proposed. The spread spectrum system and the PSK system are adapted for embedding additional information to an audio signal by utilizing a masking effect with respect to the auditory sense in reproducing an audio signal. However, since these systems cannot provide a sufficient masking effect, it is difficult to embed the additional information into the audio signal without deteriorating the quality of the reproduced sound.

DISCLOSURE OF THE INVENTION

In view of the foregoing status of the art, it is an object of the present invention to provide a novel additional information embedding method and device and an additional information demodulation method and device which enable solution of the foregoing problems.

It is another object of the present invention to provide an additional information embedding method and device which enable embedment of additional information into an audio signal without deteriorating the quality of a reproduced sound, and an additional information demodulation method and device which enable demodulation of additional information without deteriorating the sound quality of an audio signal in which the additional information is embedded.

It is still another object of the present invention to provide an additional information embedding method and device and an additional information demodulation method and device which enable embedment of additional information into an audio signal without easily being subject to damages even in the case where the audio signal is demodulated from a digital signal to an analog signal or in the case where the data format is changed.

It is a further object of the present invention to provide an additional information embedding method and device which enable easy embedment of additional information into a compressed audio signal, and an additional information demodulation method and device which enable demodulation of the embedded additional information in the data-compressed state.

An additional information embedding method for embedding additional information into an audio signal according to the present invention includes: an orthogonal transform step of orthogonally transforming an audio signal and thus calculating an orthogonal transform coefficient; and a shift and addition step of damping and shifting the orthogonal transform coefficient in the direction of the frequency axis and adding the resultant coefficient to the original orthogonal transform coefficient so as to embed the additional information.

The orthogonal transform step includes MDCT of the audio signal so as to calculate an MDCT coefficient, and the shift and addition step includes damping and shifting the calculated MDCT coefficient in the direction of the frequency axis and adding the resultant coefficient to the original MDCT coefficient so as to embed the additional information.

The method of the present invention further includes a step of scrambling the signal calculated by the shift and addition step, using a pseudo-random signal.

The additional information embedded into the audio signal is limitation information for prohibiting transfer of the audio signal, limitation information for prohibiting recording of the audio signal to a recording medium, and work data corresponding to the audio signal.

Moreover, in the method of the present invention, the shift and addition step includes adding the orthogonal transform coefficient shifted on the frequency axis to the original orthogonal transform coefficient so that a frequency masking condition and a temporal masking condition are met.

Also, the shift and addition step includes adding in the case where the value obtained by adding the shifted orthogonal transform coefficient to the original orthogonal transform coefficient is not higher than a predetermined value.

Moreover, the shift and addition step includes prohibiting shift and addition in accordance with the polarity of the value obtained by adding the shifted orthogonal transform coefficient to the original orthogonal transform coefficient.

Furthermore, the shift and addition step includes shifting and adding in the case where the audio signal falls within a range from an upper limit value to a lower limit value. In this case, the shift and addition step includes shifting and adding in the case where the audio signal falls within a range from an upper limit value to a lower limit value set on the basis of the human auditory characteristics.

Also, the shift and addition step includes shifting and adding an orthogonal transform coefficient within a predetermined frequency band.

Moreover, the shift and addition step includes dividing the frequency band of the audio signal and carrying out shift and addition for each of the divided frequency bands. In this case, the shift and addition step includes reversing the shifting direction of the divided adjacent frequency bands.

Furthermore, the shift and addition step includes shifting the MDCT coefficient toward the frequency-increasing side and adding the MDCT coefficient to the original MDCT coefficient. In this case, at the shift and addition step, the frequency of the MDCT coefficient is increased by ((sampling frequency/number of samples of MDCT coefficient)×2N) Hz, as the MDCT coefficient is shifted by 2N units (where N is a natural number). The shift and addition step is substantially equal to the amplitude of the audio signal.

Also, the shift and addition step includes shifting the MDCT coefficient toward the frequency-decreasing side and adding the MDCT coefficient to the original MDCT coefficient. In this case, at the shift and addition step, the frequency of the MDCT coefficient is decreased by ((sampling frequency/number of samples of MDCT coefficient)×2N) Hz, as the MDCT coefficient is shifted by 2N units (where N is a natural number).

An additional information embedding device for embedding additional information into an audio signal according to the present invention includes: orthogonal transform means for orthogonally transforming an audio signal and thus calculating an orthogonal transform coefficient; and shift and addition means for damping and shifting the orthogonal transform coefficient in the direction of the frequency axis and adding the resultant coefficient to the original orthogonal transform coefficient so as to embed the additional information.

The orthogonal transform step means carries out MDCT of the audio signal so as to calculate an MDCT coefficient, and the shift and addition means damps and shifts the calculated MDCT coefficient in the direction of the frequency axis and adds the resultant coefficient to the original MDCT coefficient so as to embed the additional information.

The additional information embedding device according to the present invention further includes means for scrambling the signal calculated by the shift and addition means, using a pseudo-random signal.

A demodulation method according to the present invention for receiving an audio signal in which additional information is embedded and demodulating the additional information includes: a receiving step of receiving an audio signal in which additional information is embedded by damping and shifting in the direction of the frequency axis and adding to the audio signal on the original frequency axis; and a demodulation step of demodulating the additional information on the basis of the polarity of the audio signal at each predetermined interval on the frequency axis, of the received signal. The receiving step includes receiving the audio signal in which the additional information is embedded by damping and shifting in the direction of the frequency axis an orthogonal transform coefficient calculated by orthogonally transforming the audio signal and adding the resultant orthogonal transform coefficient to the original orthogonal transform coefficient. Also, the receiving step includes receiving the audio signal in which the additional information is embedded by damping and shifting in the direction of the frequency axis an MDCT coefficient calculated by MDCT of the audio signal and adding the resultant MDCT coefficient to the original MDCT coefficient.

Moreover, the receiving step includes receiving the audio signal in which the additional information is embedded by amplitude modulation (AM modulation), and the demodulation step includes demodulating the additional information on the basis of the polarity of the audio signal at each predetermined interval on the frequency axis, of the received signal.

Furthermore, the receiving step includes receiving the audio signal in which the additional information is embedded by FM modulation, and the demodulation step includes demodulating the additional information on the basis of the polarity of the audio signal at each predetermined interval on the frequency axis, of the received signal.

Also, the demodulation step includes demodulating the additional information on the basis of the polarity of the audio signal at each predetermined interval on the frequency axis within a predetermined frequency band of the received signal.

A demodulation device according to the present invention for receiving an audio signal in which additional information is embedded and demodulating the additional information includes: receiving means for receiving an audio signal in which additional information is embedded by damping and shifting in the direction of the frequency axis and adding to the audio signal on the original frequency axis; and demodulation means for demodulating the additional information on the basis of the polarity of the audio signal at each predetermined interval on the frequency axis, of the received signal. The receiving means receives the audio signal in which the additional information is embedded by damping and shifting in the direction of the frequency axis an orthogonal transform coefficient calculated by orthogonally transforming the audio signal and adding the resultant orthogonal transform coefficient to the original orthogonal transform coefficient.

Also, the receiving means receives the audio signal in which the additional information is embedded by damping and shifting in the direction of the frequency axis an MDCT coefficient calculated by MDCT of the audio signal and adding the resultant MDCT coefficient to the original MDCT coefficient.

Moreover, the receiving means receives receiving the audio signal in which the additional information is embedded by AM modulation, and the demodulation means demodulates the additional information on the basis of the polarity of the audio signal at each predetermined interval on the frequency axis, of the received signal.

Furthermore, the receiving means receives the audio signal in which the additional information is embedded by FM modulation, and the demodulation means demodulates the additional information on the basis of the polarity of the audio signal at each predetermined interval on the frequency axis, of the received signal.

Also, the demodulation means demodulates the additional information on the basis of the polarity of the audio signal at each predetermined interval on the frequency axis within a predetermined frequency band of the received signal.

Other objects and specific advantages of the present invention will be clarified further by the following description of embodiments.

BEST MODE FOR CARRYING OUT THE INVENTION

The additional information embedding method and device and the additional information demodulation method and device according to the present invention will now be described with reference to the drawings.

Figure 1:
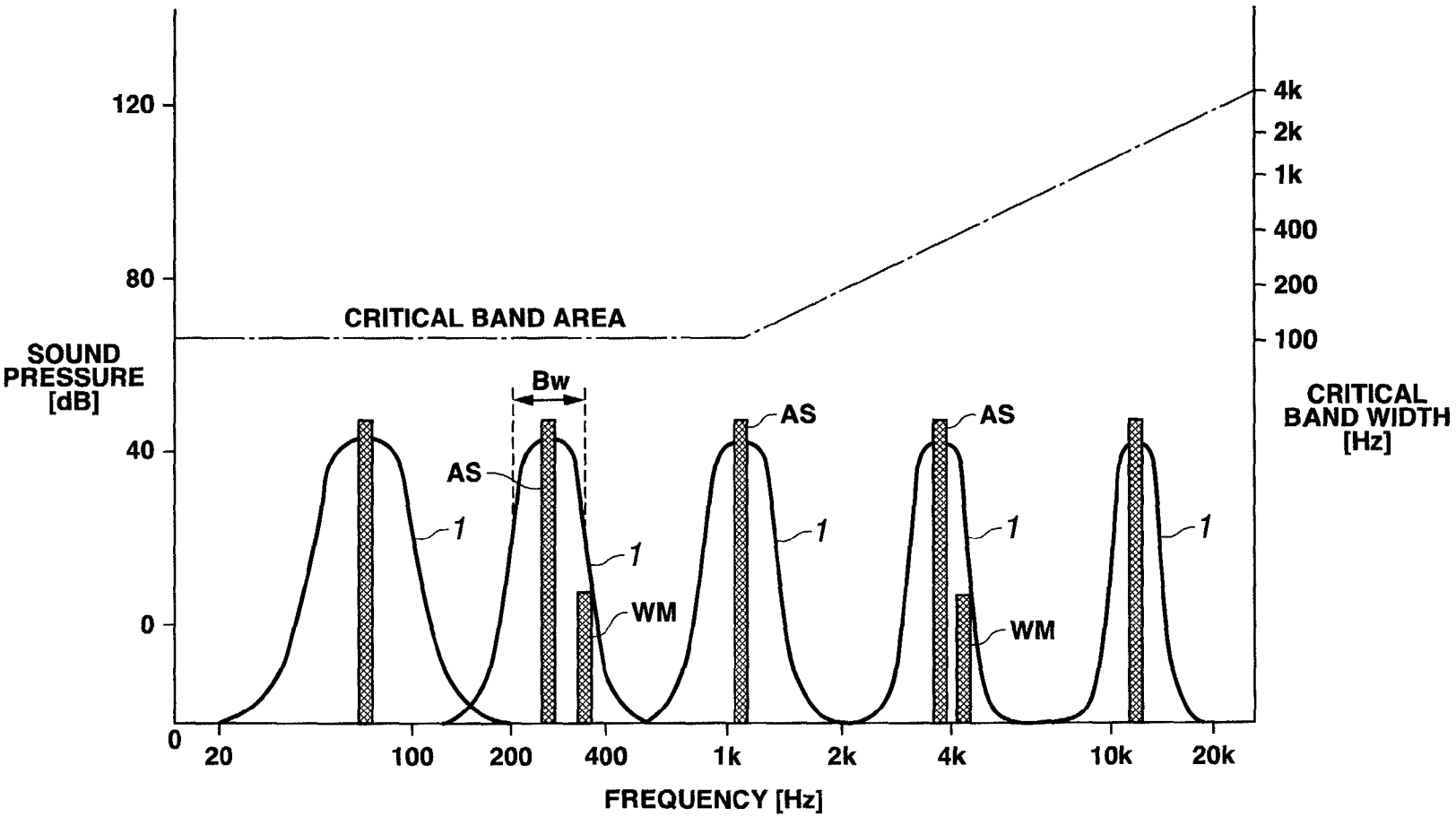
FIG. 1 illustrates frequency masking of an audio signal.

Prior to the description of the present invention, a sound masking effect will be explained. The masking effect means a state such that with respect to a masker which is a sound having a certain frequency and a predetermined sound pressure level or higher, the human auditory sense does not respond to a sound having a frequency shifted within a predetermined range and the sound pressure level or lower. When there is a sound Ms having a certain frequency and a predetermined sound pressure or higher, the human auditory sense does not response to a sound WM of not higher than a sound pressure level indicated by a masking curve 1 within a predetermined frequency region Bw shown in FIG. 1. For example, with respect to a sound As in a frequency band of 1 kHz or lower, the human auditory sense does not response to a sound WM of not higher than the sound pressure level indicated by the masking curve 1 within the range of the critical bandwidth Bw of 100 Hz around that audio signal. The critical bandwidth Bw is dependent on the frequency and the frequency bandwidth is gradually broadened at 1 kHz or higher, as shown in FIG. 1.

The masking effect also includes what is called temporal masking effect. With this temporal masking effect, even the sound WM, which is a maskee to be masked at the sound pressure level indicated by the masking curve 1 or lower in the direction of the time base, will be caught by the human auditory sense if it is shifted in the direction of the time base with respect to the sound As, which serves as a masker of a certain frequency and the predetermined sound pressure level or higher. For example, depending on the listener, the maskee sound WM might be heard in such a manner that it is shifted several milliseconds forward or several milliseconds backward in the direction of the time base with respect to the masker sound As.

Thus, in order to embed additional information as a maskee into an audio signal as a masker, the additional information must be added within the range of the sound pressure level indicated by the masking curve or lower with respect to the audio signal as the masker, in consideration of the above-described masking effect. In consideration of the temporal masking effect, the additional information must not be largely shifted in the direction of the time base with respect to the audio signal as the masker.

Figure 2A:
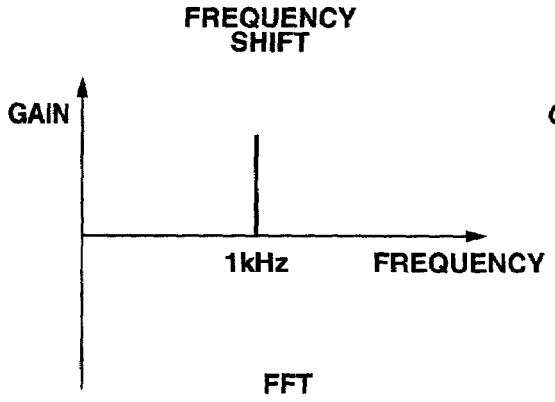
FIG. 2A is a graph showing the result of MDCT of an audio signal as a sine wave.
Figure 2B:
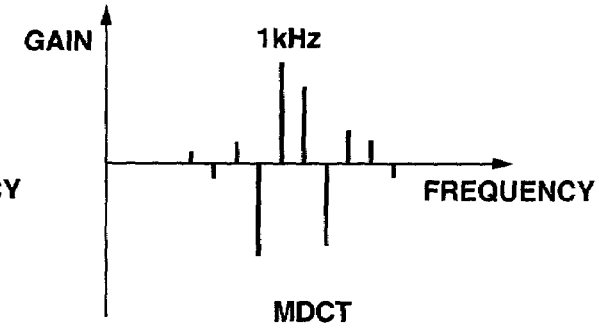
FIG. 2B shows the result of fast Fourier transform of an audio signal as a sine wave.

The audio signal handled in the present invention will now be described. The audio signal has a sine wave of various frequencies superimposed thereon. If this sine wave is transformed by fast Fourier transform (FFT), one spectrum (fast Fourier transform coefficient) is generated at a certain frequency, as shown in FIG. 2A. On the other hand, if the sine wave is transformed by MDCT (modified discrete cosine transform), a plurality of MDCT coefficients of both polarities are generated at a plurality of frequencies, as shown in FIG. 2B. As shown in FIG. 2B, the four MDCT coefficients in the central area occupy approximately 90% of the whole. In FIGS. 2A and 2B, the vertical axis represents the gain (or level).

Figure 3A:
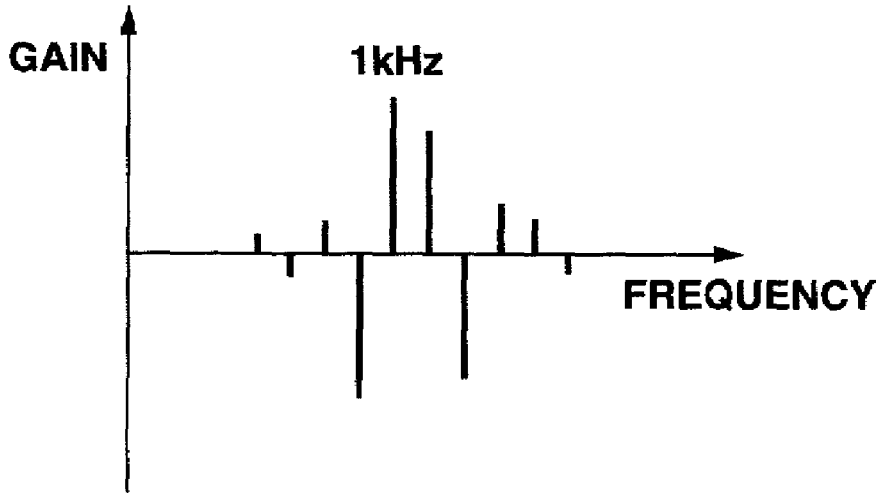
FIGS. 3A and 3B are graphs showing the state where the MDCT coefficient is shifted in the direction of the frequency axis.
Figure 3B:
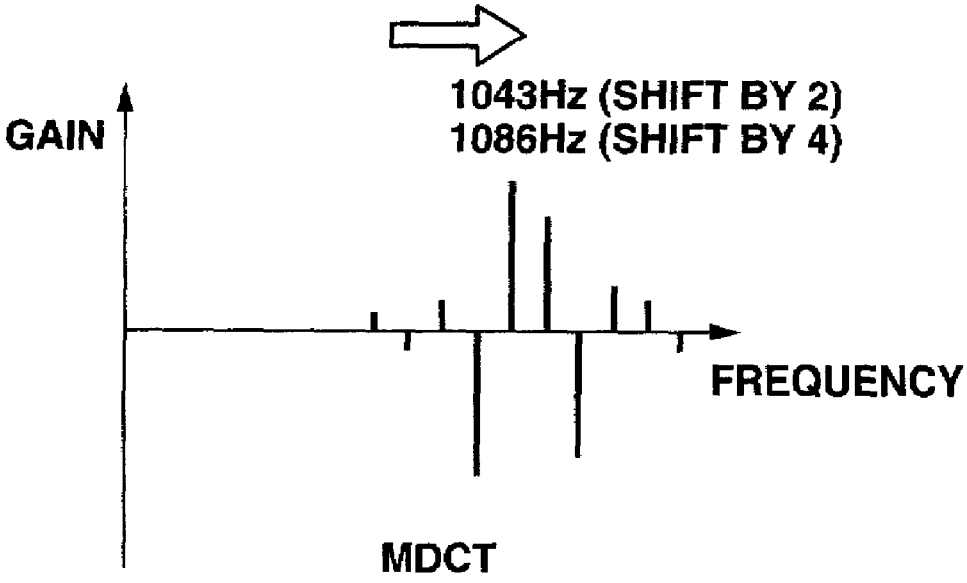
Figure 4A:
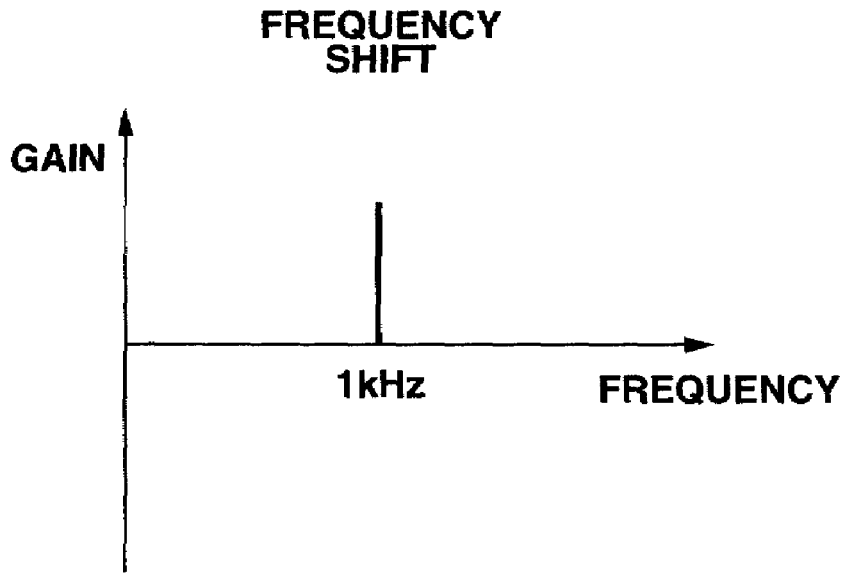
FIGS. 4A and 4B are graphs showing the change of the frequency in the case where the MDCT coefficient is shifted in the direction of the frequency axis.
Figure 4B:
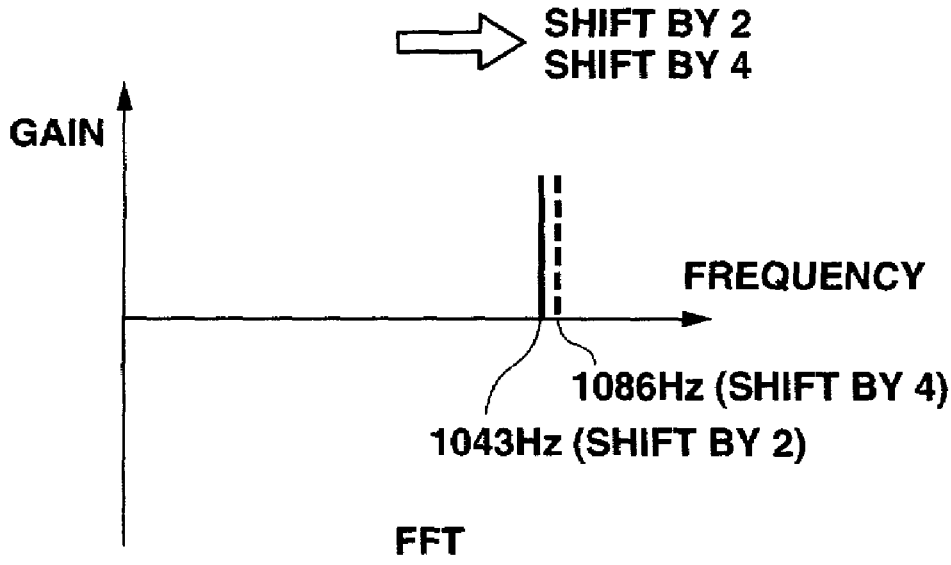

The MDCT coefficients obtained by carrying out MDCT of the sine wave have the following characteristics. That is, if the entire MDCT coefficients are shifted by an even number of units in the direction of the frequency axis so as to carry out inverse MDCT (IMDCT), the result is a signal obtained by frequency shifting on the PCM signal due to the characteristics of the MDCT and inverse MDCT. For example, if an audio signal of 1 kHz is sampled by a frequency of 44.1 kHz, then the 1024 sample values are transformed by MDCT as shown in FIG. 3A, and the resultant MDCT coefficients are shifted by two to the right on the frequency axis and transformed by inverse MDCT as shown in FIG. 3B, the audio signal of 1 kHz shown in FIG. 4A becomes a signal with its frequency raised by 43 Hz as shown in FIG. 4B. Similarly, if the resultant MDCT coefficients are shifted by four to the right as shown in FIG. 4B and then transformed by inverse MDCT, a signal with its frequency raised by 86 Hz is obtained as shown in FIG. 3B. Thus, as described above, if the entire MDCT coefficients are shifted by two to the right in the direction of the frequency axis, a signal of 1043 Hz shown in FIG. 4B obtained by shifting the audio signal of 1 kHz shown in FIG. 4A is generated. If the entire MDCT coefficients are shifted by four, a signal of 1086 Hz shown in FIG. 4B is generated.

Figure 5A:
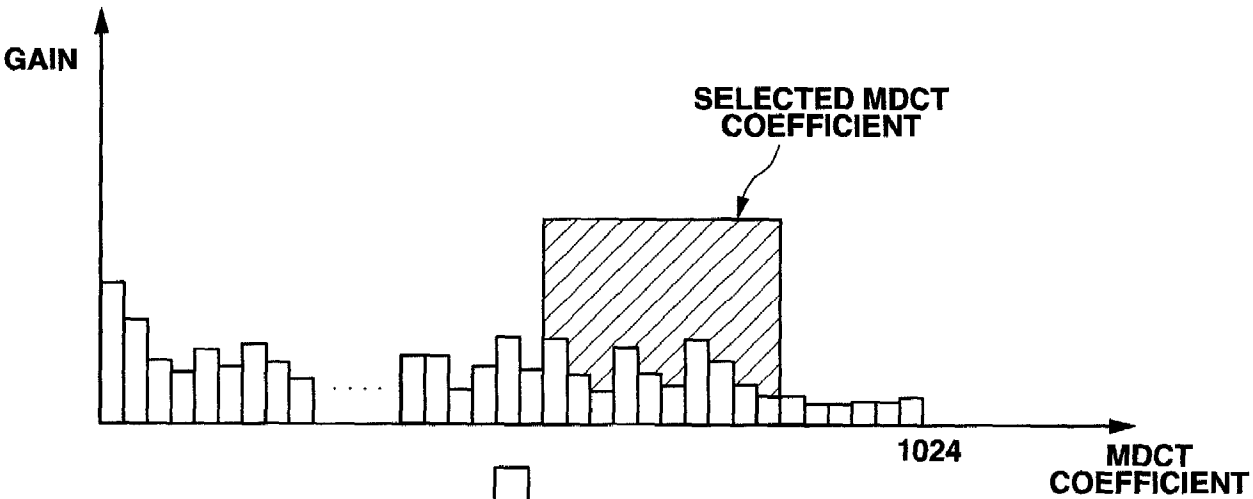
FIGS. 5A and 5B are graphs showing frequency selection processing of a watermark embedded into an audio signal.
Figure 5B:
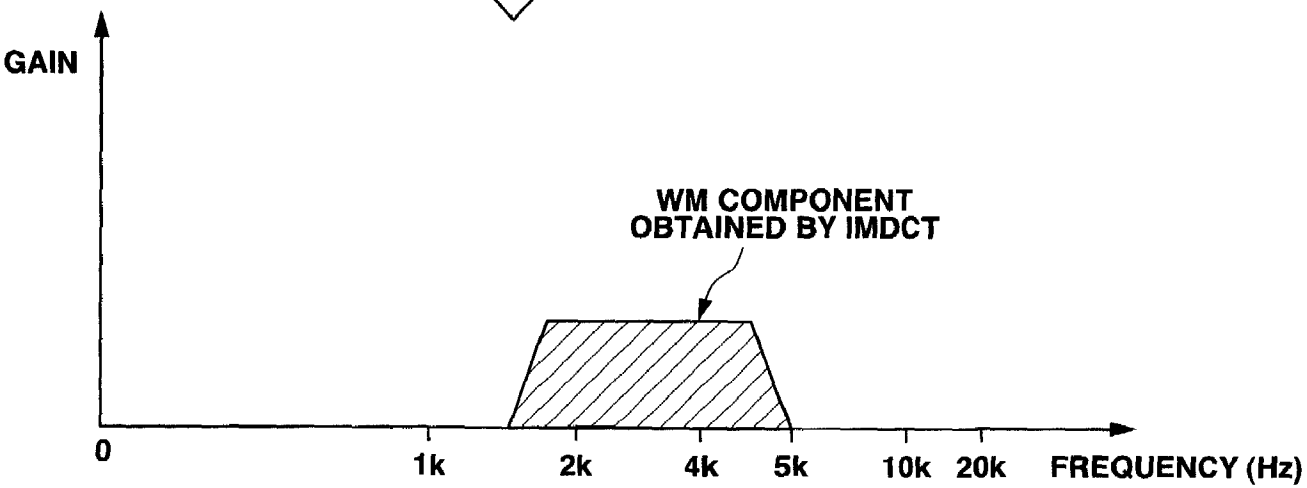

By sampling a typical audio signal by a frequency of 44.1 kHz, then carrying out MDCT of the 1024 sample values, then selecting a predetermined number of MDCT coefficient from the resultant MDCT coefficients as shown in FIG. 5A, and carrying out inverse MDCT of the selected MDCT coefficients, the modulation result with the frequency limitation can be obtained. Thus, additional information can be embedded as a watermark WM into a signal limited to a band of 1.5 to 5 kHz as shown in FIG. 5B, instead of the entire frequencies of the audio signal.

As a method for embedding additional information as a watermark WM into an audio signal, there is employed a system which generates the additional information directly from the audio signal itself, that is, a system which uses a component of a predetermined frequency band wave included in the audio signal as the additional information and embed the additional information as a watermark WM within a range where the masking effect shown in FIG. 1 is obtained.

Figure 6A:
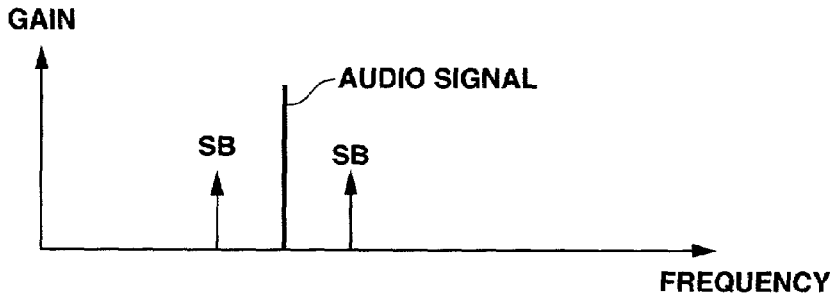
FIG. 6A is a graph showing the signal characteristics in a frequency region of a signal obtained by amplitude-modulating an audio signal by a sine wave.
Figure 6B:
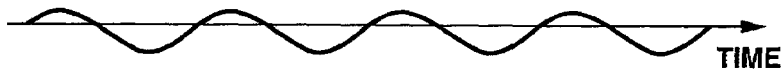
FIG. 6B is a graph showing the original audio signal.
Figure 6C:
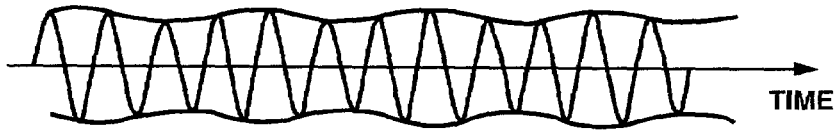
FIG. 6C is a graph showing a signal obtained by amplitude-modulating the audio signal of FIG. 6B by a sine wave.

As one of such systems, an AM modulation system may be employed. The AM modulation system is adapted for carrying out processing as shown in FIGS. 6A, 6B and 6C. Specifically, if an envelope of a signal (sine wave) of a specified frequency of the original audio signal into which the additional information is to be embedded is amplitude-modulated by a sine wave shown in FIG. 6B, as shown in FIG. 6C, side band signals SB appear on both sides of the original audio signal as shown in FIG. 6A, and the side band signals SB are caused to fall within the range of the masking curve 1 shown in FIG. 1. By utilizing the side band signals SB, the additional information can be embedded as a watermark into the audio signal.

Figure 7A:
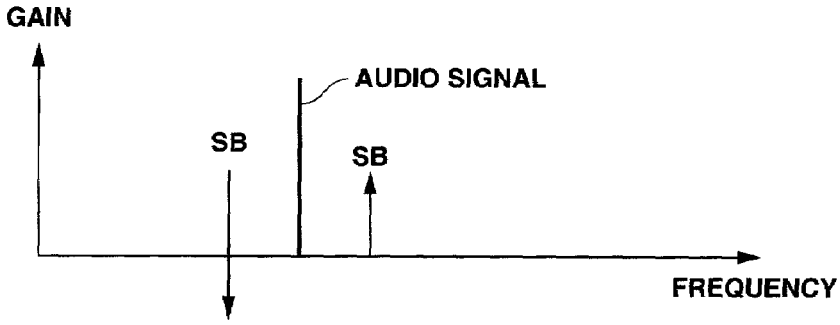
FIG. 7A is a graph showing the signal characteristics in a frequency region of a signal obtained by frequency-modulating an audio signal by a sine wave.
Figure 7B:
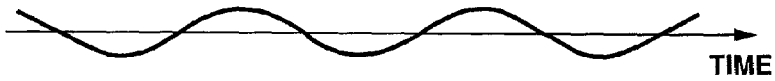
FIG. 7B is a graph showing the original audio signal.
Figure 7C:
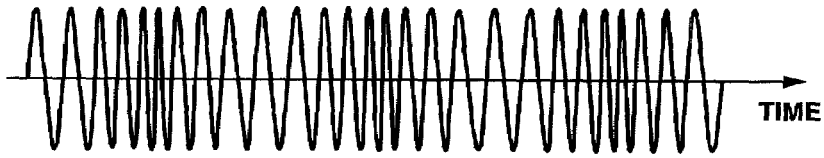
FIG. 7C is a graph showing a signal obtained by frequency-modulating the audio signal of FIG. 7B by a sine wave.

As another system, an FM modulation system may be employed. The FM modulation system is adapted for carrying out processing as shown in FIGS. 7A, 7B and 7C. Specifically, if a signal (sine wave) of a specified frequency of the audio signal into which the additional information is to be embedded is frequency-modulated by a sine wave shown in FIG. 7B, as shown in FIG. 7C, side band signals SB appear on both sides of the original audio signal as shown in FIG. 7A, and the side band signals SB are caused to fall within the range of the masking curve 1 shown in FIG.

1. By utilizing the side band signals SB, the additional information can be embedded as a watermark into the audio signal.

Figure 8A:
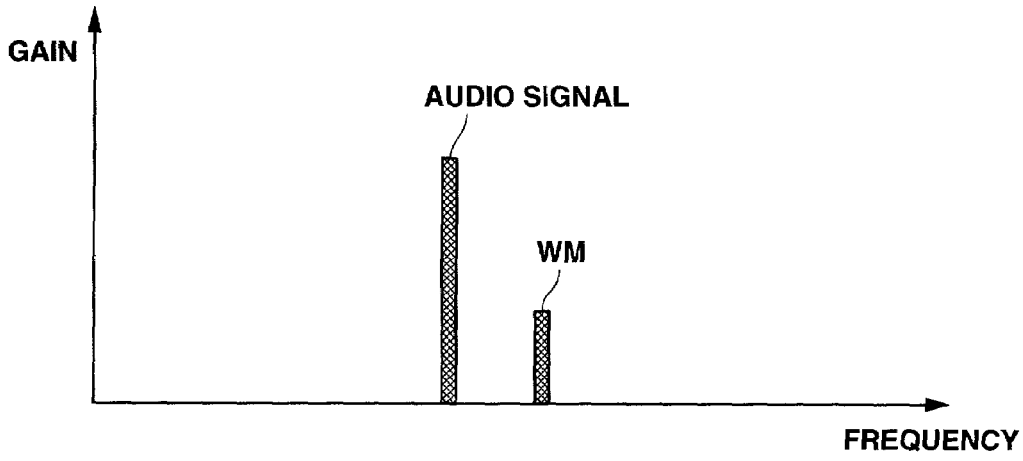
FIG. 8A is a graph showing an example of embedment of a watermark into a high frequency band side of the original audio signal.
Figure 8B:
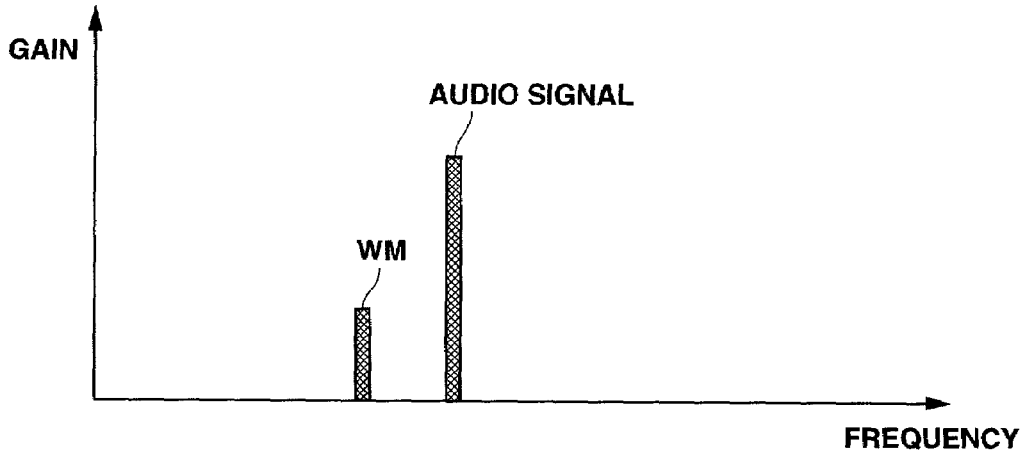
FIG. 8B is a graph showing an example of embedment of a watermark into a low frequency band side of the original audio signal.

Moreover, in the case of embedding additional information as a watermark into an audio signal, the additional information may be embedded as a watermark WM into either a high-frequency band of a signal of a specified frequency of the audio signal to which the additional information is to be embedded, as shown in FIG. 8A, or a low-frequency band of the signal of the specified frequency, as shown in FIG. 8B. In both cases of FIGS. 8A and 8B, the watermark WM is embedded with the gain damped to fall within the range of the masking curve 1 of the audio signal of the specified frequency, as shown in FIG. 1.

A method for demodulating additional information which is embedded as a watermark WM within the range of the masking curve 1 of the audio signal, by damping the MDCT coefficient obtained by MDCT and decoding of the audio signal and then shifting the MDCT coefficient in the direction of the frequency axis, will now be described.

Figure 9:
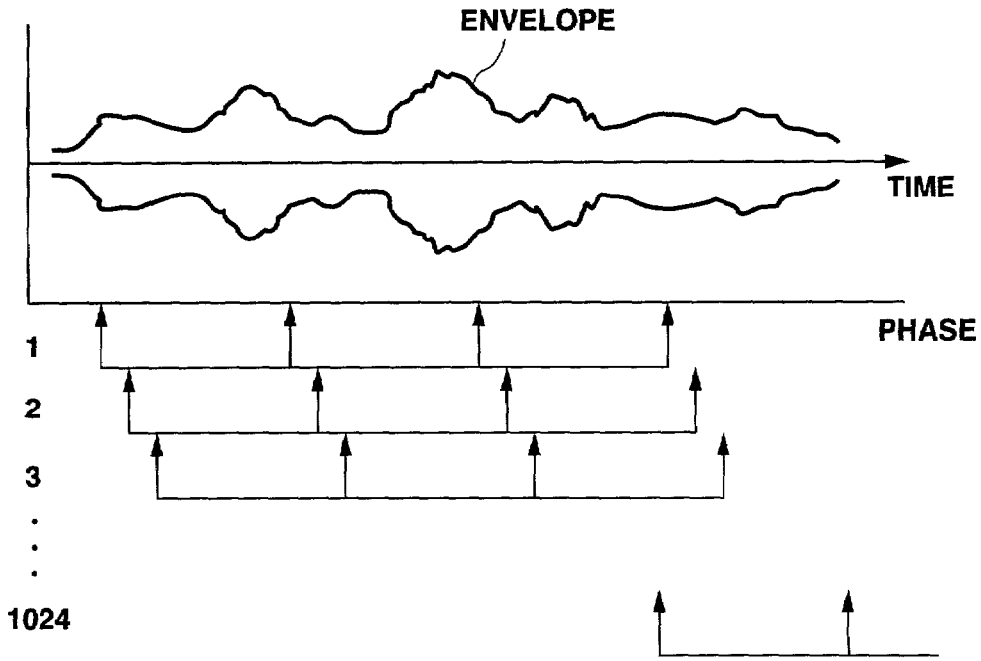
FIG. 9 is a graph illustrating an MDCT coefficient calculation method.

In the case of demodulating the MDCT coefficient obtained by MDCT of the audio signal, correct demodulation cannot be carried out if there is a shift between the 1024 samples as a MDCT unit at the time of modulation and the 1024 transform coefficients as an inverse MDCT unit at the time of demodulation. Therefore, to correctly demodulate the additional information, 1024 times of inverse MDCT must be carried out with the phases of the transform coefficients shifted one by one, as shown in FIG. 9. Such multiple times of inverse MDCT is impractical in consideration of the processing time and processing speed, and also requires excessive increase in the circuit scale.

The additional information which is embedded into the audio signal by shifting in the direction of the frequency axis the MDCT coefficient obtained by MDCT of the audio signal has the correlation with the original audio signal. Thus, demodulation of the additional information embedded in the audio signal is carried out utilizing the characteristics of the additional information. In this demodulation, the additional information can be easily demodulated by adding the MDCT coefficient shifted in the direction of the frequency axis to the original MDCT coefficient obtained by MDCT of the audio signal.

Figures 10A, 10B:
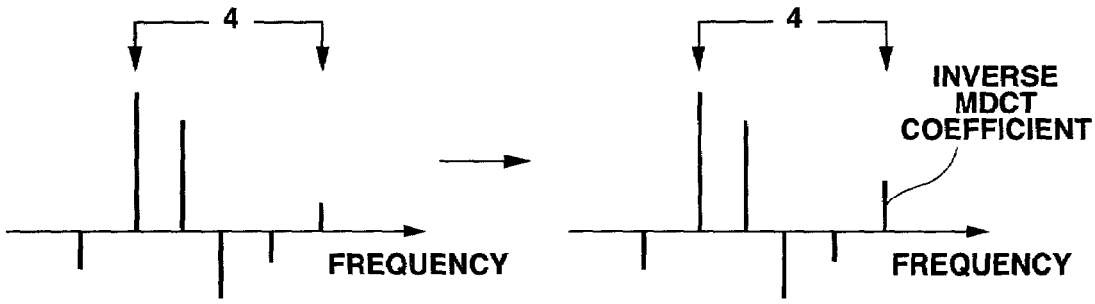
FIGS. 10A and 10B are graphs showing replacement of the MDCT coefficient.

Specifically, if the MDCT coefficients shown in FIG. 10A obtained by MDCT of the audio signal are shifted by four in the direction of the frequency axis and then added to the original MDCT coefficients, there is a high probability that the polarity of the original MDCT coefficients and the polarity of the added MDCT coefficients are of the same phase, as shown in FIG. 10B. That is, as shown in FIG. 10B, the MDCT coefficients which are added in the direction of the frequency axis and of the same phase as the original MDCT are increased, and those of the inverse phase are decreased. Thus, the polarity of the MDCT coefficients shown in FIG. 10B, obtained by shifting the MDCT coefficient by four in the direction of the frequency axis and adding the resultant MDCT coefficients, is counted with respect to the same phase or the inverse phase and statistical processing is carried out, thus detecting whether the shifted MDCT coefficients are added as the same phase or as the inverse phase. By doing so, the modulated additional information can be easily demodulated without carrying out multiple times of inverse MDCT even in the case where there is a shift between the 1024 samples as a MDCT unit at the time of modulation and the 1024 transform coefficients as an inverse MDCT unit at the time of demodulation.

In this case, the MDCT coefficients are shifted by four in the direction of the frequency axis in order to realize a high probability that the polarity of the MDCT coefficients is of the same phase. However, the MDCT coefficients may be shifted by 2N (where N is a natural number).

Meanwhile, in demodulating the additional information, there are some MDCT coefficients which do not contribute to increase or decrease of the polarity, of the MDCT coefficients shifted in the direction of the frequency axis and added to or subtracted from the original MDCT coefficients obtained by MDCT and decoding of the audio signal. That is, of the MDCT coefficients shifted in the direction of the frequency axis, there are some MDCT coefficients the polarity of which is not changed by addition to or subtraction from the original MDCT coefficients.

Figure 11A:
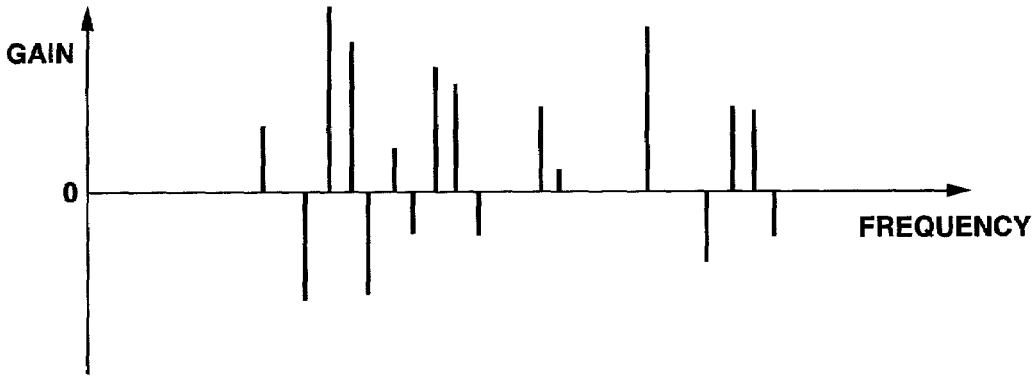
FIG. 11A is a graph showing the MDCT coefficient of the original audio signal.
Figure 11B:
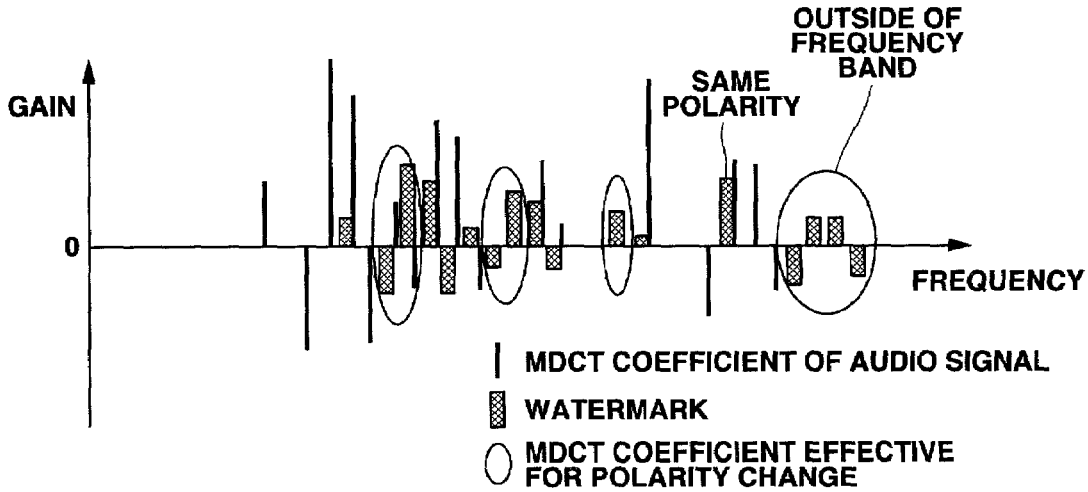
FIG. 11B is a graph showing the state where an MDCT coefficient shifted in the direction of the frequency axis is added to the MDCT coefficient of the original audio signal.
Figure 11C:
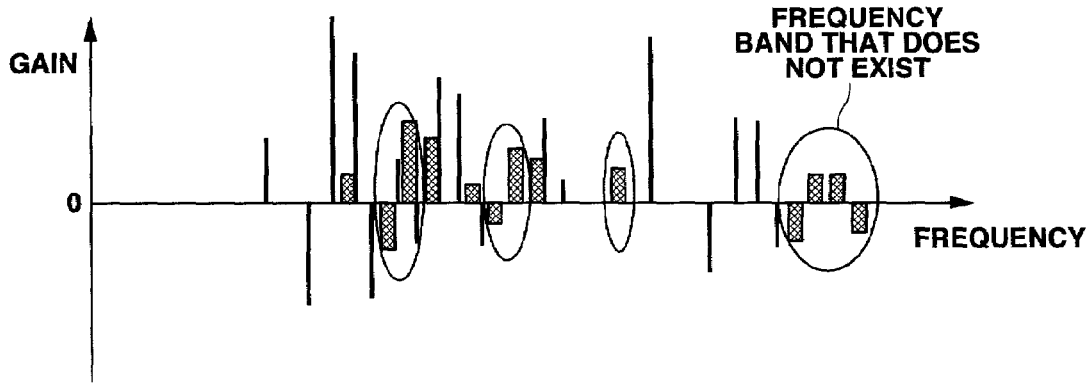
FIG. 11C is a graph showing the state where an originally nonexistent polarity change is generated when the MDCT coefficient shifted in the direction of the frequency axis is added to the MDCT coefficient of the original audio signal.

Specifically, the MDCT coefficients shifted by four in the direction of the frequency axis are added to the original MDCT coefficients shown in FIG. 11A obtained by MDCT of the audio signal. In this case, the MDCT coefficients to be added have the gain reduced by a predetermined level, for example, approximately 30 dB, as shown in FIG. 11B, and then added to the original MDCT coefficients. The result of addition is as shown in FIG. 11C. Even in such case where the MDCT coefficients with the gain reduced by 30 dB is added to the original MDCT coefficients, there are some MDCT coefficients which neither contribute to inversion of the polarity of the original MDCT coefficients nor function as a watermark as they exceed the masking level of an audio signal of a predetermined frequency. Therefore, there is a risk of deterioration in the quality of the reproduced sound.

In order to solve such problems, it may be considered to add only the MDCT coefficients having a level greater than that of the original MDCT coefficients and having the inverse phase. However, even in the case where such processing is completely carried out, there is a risk that the additional information embedded in the audio signal cannot be demodulated when the MDCT-transformed audio signal is converted to an analog signal and MDCT-transformed again by a block of a different sample value. That is, there is a risk that the additional information might be lost when the MDCT coefficients shifted in the direction of the frequency axis are added to the MDCT coefficients obtained by MDCT-transforming again the audio signal converted to the analog signal, by the processing similar to the above-described processing.

Figure 12A:
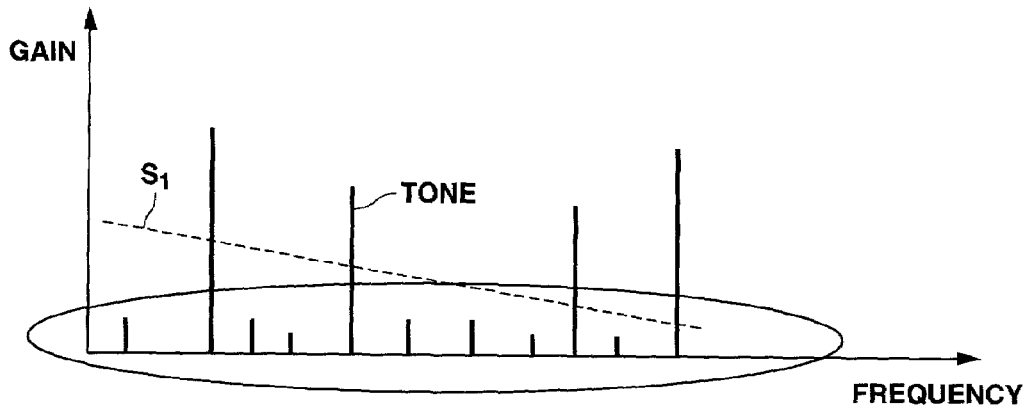
FIG. 12A is a graph showing the state where the MDCT coefficient to which a watermark is to be embedded is selected in accordance with the level of the MDCT coefficient.
Figure 12B:
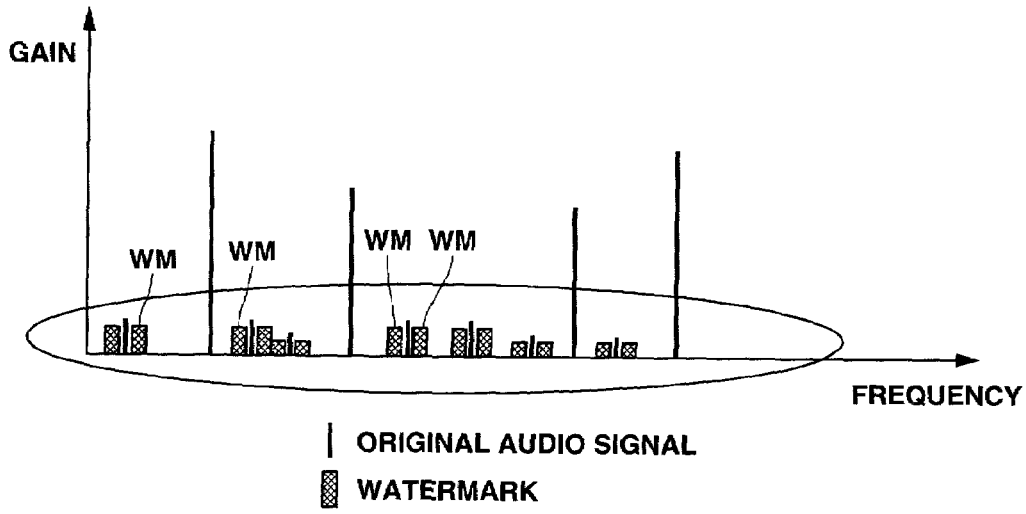
FIG. 12B is a graph showing the state where additional information is embedded as a watermark around the MDCT coefficient selected in FIG. 12A.

Thus, in order to prevent damage to the additional information embedded in the audio signal and to prevent deterioration in the sound quality of the demodulated audio signal, only the MDCT coefficients having a gain not higher than a predetermined level, of the MDCT coefficients obtained by MDCT of the audio signal into which the additional information is embedded, are used for embedment of the additional information. With respect to a sound of a predetermined frequency, a sound of a shifted frequency and not lower than a certain sound pressure level cannot provide an auditory masking effect. In consideration of such sound characteristics, a threshold value S1 is provided on the gain and frequency of the MDCT coefficients used for the additional information in view of the human auditory sense, as shown in FIG. 12A, and only the MDCT coefficients within the range of not higher than the threshold value S1 are used for embedment of the additional information. The MDCT coefficients selected in this case are shifted by four in the direction of the frequency axis, then have the gain reduced, and are added to the original MDCT coefficients. Thus, the additional information is embedded as watermarks WM on both side of the original MDCT coefficients, as shown in FIG. 12B. In this case, as shown in FIG. 12B, the additional information of not lower than the predetermined level can be prevented from being embedded at positions away by a predetermined frequency from the original MDCT coefficients of a predetermined frequency, and generation of a sound that is reproduced as an auditory noise component can be prevented.

Figure 13A:
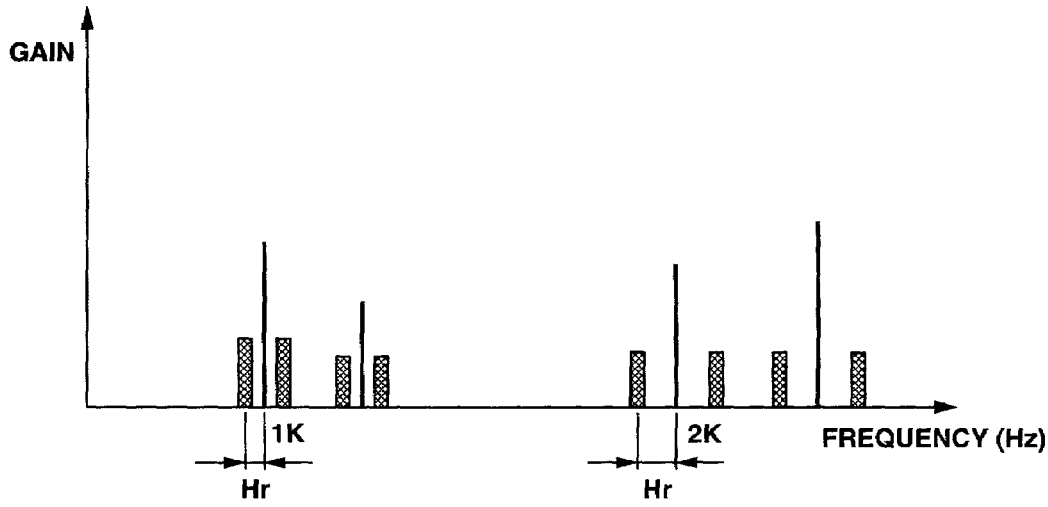
FIG. 13A is a first graph showing an example of frequency band limitation of the watermark.

In embedding the additional information as a watermark WM into the audio signal, if the MDCT coefficients for the additional information are embedded at positions that are constantly away by a predetermined frequency from the MDCT coefficients of a predetermined frequency, an auditory noise which is not masked might be heard when the audio signal is reproduced, as described with reference to FIG. 1. Since the frequency band where the masking effect can be obtained changes depending on the frequency, the frequency distance Hr for embedding the additional information as a watermark WM is varied in accordance with the frequency of the audio signal into which the additional information is embedded. For example, when the additional information is to be embedded as a watermark WM into an audio signal of 1 kHz or lower, the original MDCT coefficients are shifted on the frequency axis so that the MDCT coefficient for the additional information are embedded within the frequency distance Hr of 43 Hz, as shown in FIG. 13A. On the other hand, when the additional information is to be embedded as a watermark WM into an audio signal of 2 kHz or higher, the original MDCT coefficients are shifted on the frequency axis so that the MDCT coefficient for generating the additional information are embedded within the frequency distance Hr of 86 Hz, as shown in FIG. 13A.

Figure 13B:
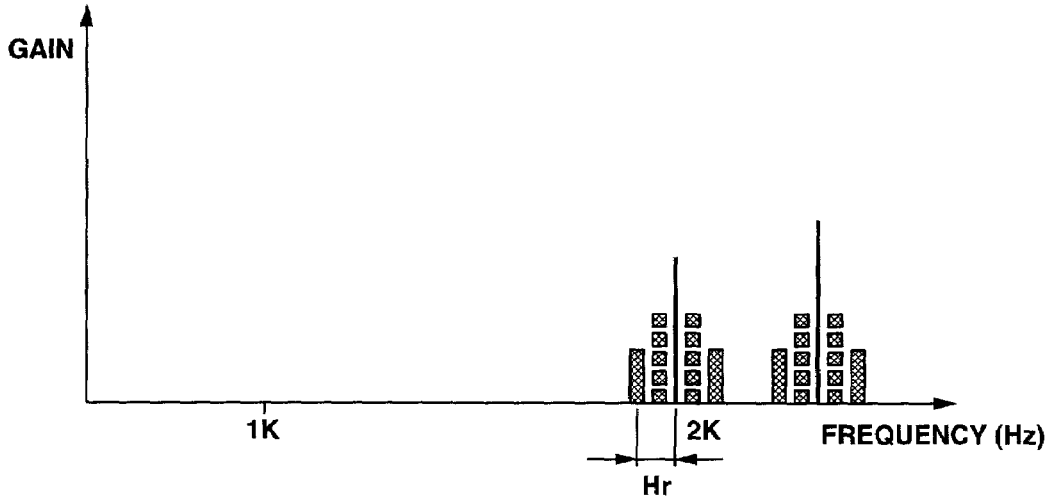
FIG. 13B is a second graph showing the example of frequency band limitation of the watermark.

Moreover, in embedding the additional information as a watermark WM into the audio signal, the frequency distance Hr for embedding the additional information as a watermark WM can be increased with respect to the audio signal of 2 kHz or higher. Thus, the MDCT coefficients for the additional information can be multiplexed and then embedded within the frequency distance Hr, as shown in FIG. 13B.

As described above, if signal compression processing using compression quantization for a video signal is carried out on the audio signal in which the additional information is embedded as a watermark WM, the additional information might be broken. This is because the amplitude of each frequency component within the frequency band of the audio signal is rounded to be smaller by the limitation of the number of quantization steps in the course of signal compression. To solve this problem, the level of the additional information to be added to the audio signal may be maintained at a predetermined level or higher. For example, by maintaining the level of the additional information at approximately −6 to −30 dB with respect to the level of an audio signal of a predetermined frequency into which the additional information is embedded, the tolerance of the additional information can be guaranteed and breakdown of the additional information can be prevented even when the audio signal in which the additional information is embedded is compressed by quantization or the like. In order to prevent breakdown of the additional information when signal compression is carried out, the use of the MDCT coefficients which are damped −30 dB or more with respect to the original MDCT coefficients for the additional information may be avoided.

Figure 14:
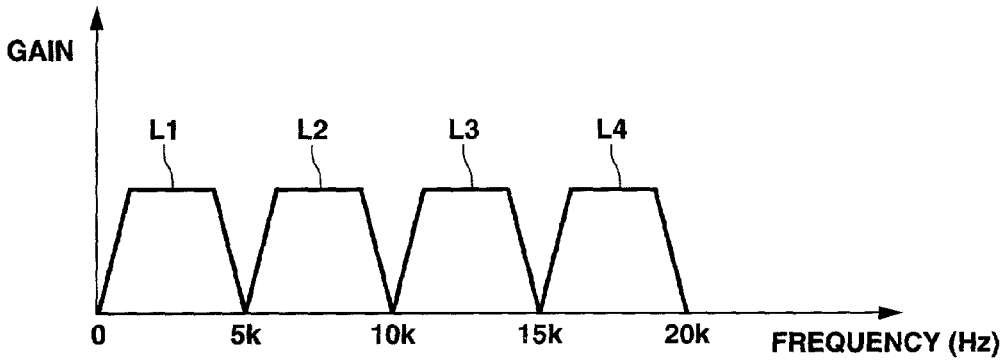
FIG. 14 is a graph showing an example of insertion of multiple information with a plurality of layers of watermark.

When shifting the MDCT coefficients obtained by MDCT of the audio signal into the direction of the frequency axis and thus embedding the additional information as a watermark WM, if the additional information to be embedded is multiplexed to a plurality of layers L1, L2, . . . , LN as shown in FIG. 14, the frequency of each layer may be set exclusively.

Figure 15A:
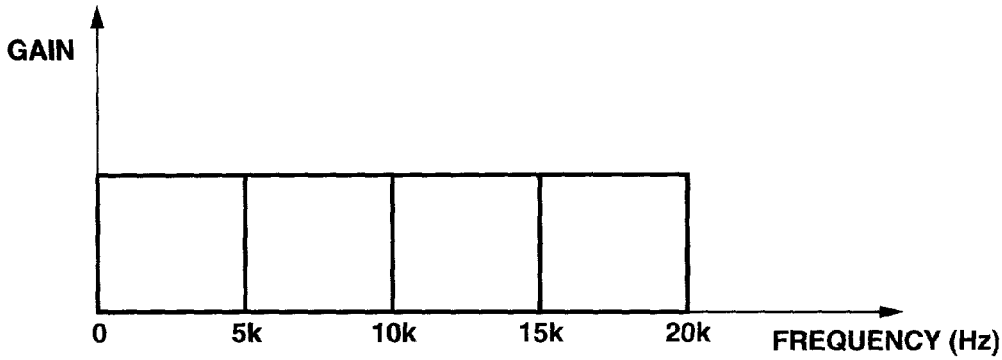
FIG. 15A is a first graph showing an example of frequency band division for division into a plurality of frequency bands.
Figure 15B:
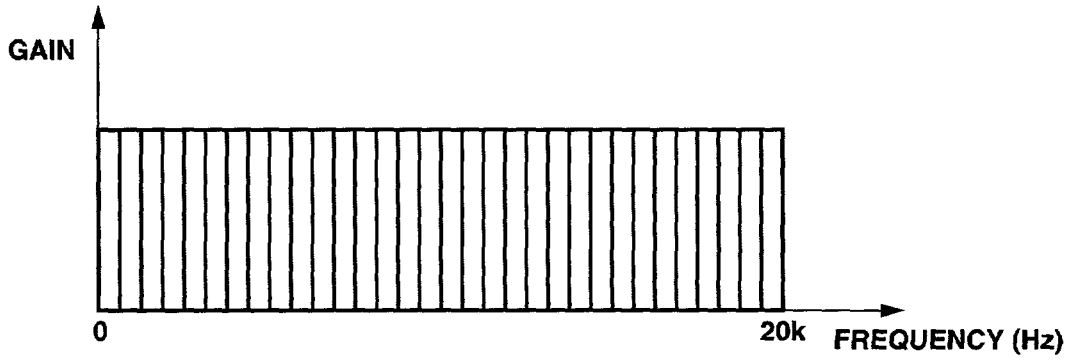
FIG. 15B is a second graph showing the example of frequency band division for division into a plurality of frequency bands.

Depending on the codec, the audio signal may be MDCT-transformed after the frequency band of the audio signal is divided into predetermined frequency bands by a data filter, as shown in FIGS. 15A and 15B. The components of such divided frequency regions may be used directly as layers. FIG. 15A shows an example in which an adaptive audio signal compression technique (ATRAC2 or Adaptive Transform Acoustic Coding: trademark of Sony Corporation) is applied and in which frequency division is carried out every 5 kHz. FIG. 15B shows an example in which an output from a subband filter divided into 32 by the MDCT layer 3 is MDCT-transformed.

As described above, in the method for embedding the additional information as a watermark WM into the audio signal by shifting the MDCT coefficients obtained by MDCT of the audio signal in the direction of the frequency axis, the level of the MDCT coefficients for generating the additional information is determined in accordance with the coincidence or non-coincidence of the polarity of the original MDCT coefficients and the polarity of the MDCT coefficients which are shifted by a predetermined number of units in the direction of the frequency axis and then added. Therefore, high levels of the MDCT coefficients do not directly affect the modulation intensity of the additional information. The MDCT coefficients of lower levels and the MDCT coefficients of higher levels have the same data quantity. Therefore, if priority is given the sound quality of the reproduced audio signal, it is desired to use the MDCT coefficients of the least possible level for generating the additional information in consideration of the masking effect of the audio signal to which the additional information is added and the tolerance of the addition information in the case where signal compression is carried out.

In the case where the level of the additional information to be added to the audio signal is to be automatically set with respect to the level of the audio signal, the maximum amplitude of the additional information can be set by limiting the addition/subtraction of the level of the audio signal. Also, by setting the lower limit of the level of the addition information to be added to the audio signal, generation of the additional information which is damaged by signal compression or repeated conversion from a digital signal to an analog signal can be prevented.

To automatically set the level of the audio signal to which the additional information is added, a method for normalizing the output of each frequency band or of each filter bank is used. In ATRAC2 or ATRAC3, an AGC circuit is provided on the stage subsequent to a polyphase quadrature filter (PQF), and therefore level adjustment is carried out before the audio signal is MDCT-transformed. Therefore, ATRAC2 or ATRAC3 can be used for the demodulation method of the present invention.

Also, as a method for automatically setting the level of the audio signal, the number of effective MDCT coefficients for generating the additional information to be added to the audio signal may be counted and the level of the MDCT coefficients for generating the additional information may be automatically limited so that a constant number of MDCT coefficients are added on the average.

The additional information embedding device for embedding additional information as a watermark into an audio signal and the demodulation device for demodulating the additional information embedded in the audio signal will now be described.

Figure 16:
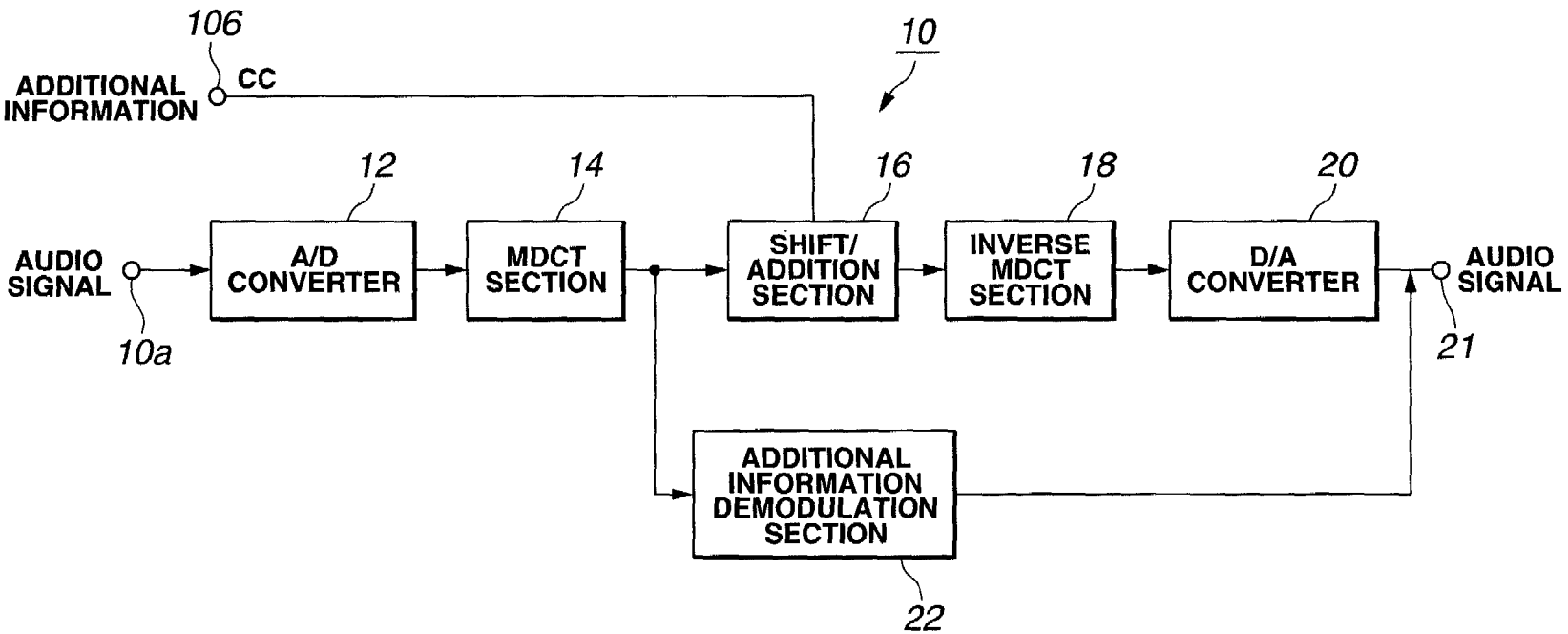
FIG. 16 is a block diagram showing a codec which superimposes additional information as a watermark onto an audio signal so as to carry out modulation and then decodes the audio signal on which the additional information is superimposed.

In the present invention, the additional information embedding device and the additional information demodulation device are integrally constituted as a codec 10, as shown in FIG. 16. This codec 10 has an A/D converter 12 for converting an audio signal inputted through an audio signal input terminal 10*a* to a digital signal, and an MDCT section 14 for MDCT-transforming (modified discrete cosine transform) the audio data converted to the digital signal by the A/D converter. The MDCT section 14 is adapted for carrying out one-dimensional orthogonal transform of a PCM signal, which is one-dimensional audio data. The MDCT section 14 carries out one-dimensional MDCT of the PCM signal and outputs a MDCT coefficient.

The codec 10 also has a shift/addition section 16 to which the MDCT coefficient calculated by the MDCT section 14 is inputted and to which additional information inputted through an additional information input terminal 10*b* is inputted. The shift/addition section 16 shifts the MDCT coefficient supplied from the MDCT section 14 into the direction of the frequency axis and carries out polarity conversion of the original MDCT coefficient on the basis of the additional information, thus embedding the additional information into the MDCT coefficient.

The signal outputted from the shift/addition section 16 is inputted an inverse MDCT section 18. The inverse MDCT section 18 carries out inverse modified discrete cosine transform, which is the opposite to the transform by the MDCT section 14, with respect to the signal outputted from the shift/addition section 16.

The digital audio data in which the additional information outputted as a digital signal from the inverse MDCT section 18 is embedded is converted to an analog audio data by a D/A converter 20 and then outputted through an output terminal 21. The audio signal outputted from the output terminal 21 is a signal in which the additional information is embedded.

The codec 10 is used as the additional information demodulation device and therefore has an additional information demodulation section 22 for demodulating the additional information embedded in the audio signal from the MDCT coefficient outputted from the MDCT section 14. The additional information demodulated by the additional information demodulation section 22 is outputted to outside of the device through the output terminal 21.

The additional information embedded as a watermark into the audio signal includes limitation information for prohibiting transfer of the audio signal, limitation information for prohibiting recording of the audio signal to another recording medium, and work data corresponding to the audio signal. The work data includes data for managing the copyright of a music tune or the like corresponding to the audio signal, the copyright holder code, the copyright management number and the like.

Figure 17:
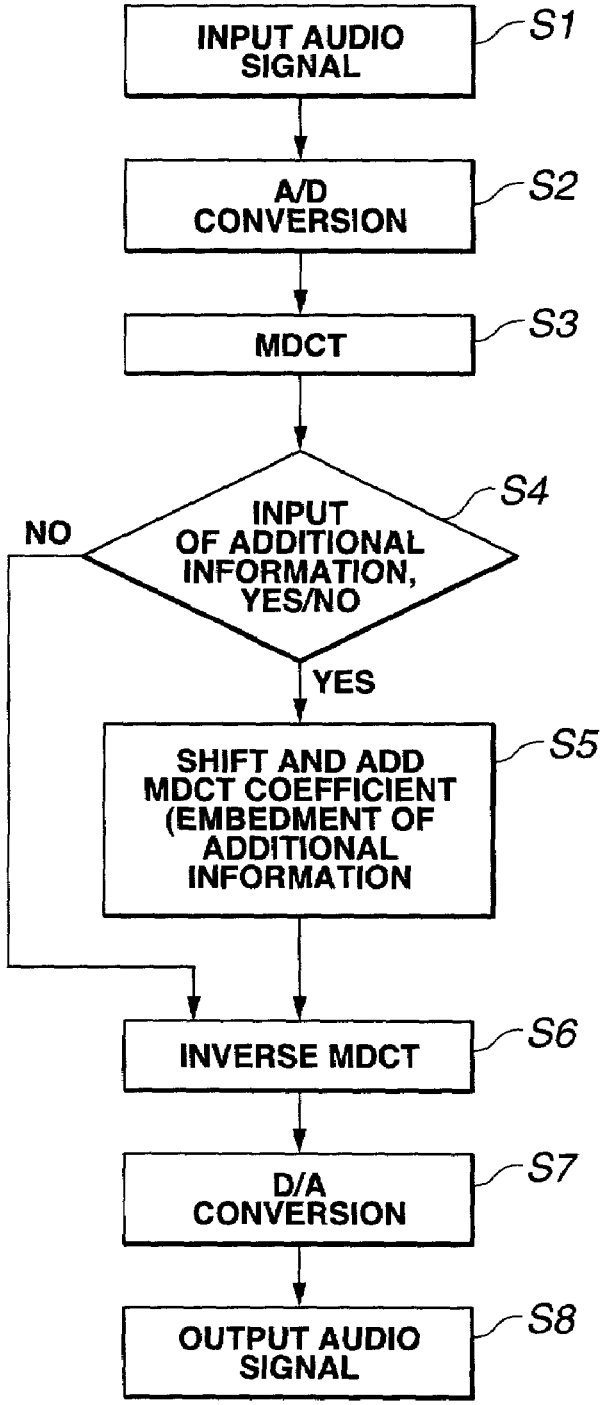
FIG. 17 is a flowchart showing the procedure for superimposing the additional information onto the audio signal.

The procedure for embedding additional information into an audio signal using the codec 10 having the additional information embedding function shown in FIG. 16 will now be described with reference to the flowchart of FIG. 17.

As an audio signal is inputted from the audio signal input terminal 10*a* at step S1, the audio signal is inputted to the A/D converter 12, where it is converted to a digital signal at step S2. The audio signal converted to the digital signal is inputted to the MDCT section 14. At step S3, the audio signal inputted to the MDCT section 14 is MDCT-transformed to calculate MDCT coefficients. The MDCT coefficients calculated by the MDCT section 14 are inputted to the shift/addition section 16.

At step S4, whether additional information is inputted to the shift/addition section 16 or not is discriminated. Specifically, when the input of the additional information indicates "1", the shift/addition section 16 at step S5 shifts the MDCT coefficients inputted from the MDCT section 14 by two or by four in the direction of the frequency axis and adds the resultant MDCT coefficients to the original MDCT coefficients, thus embedding the additional information as a watermark WM. On the other hand, when there is no input of additional information, that is, when the additional information indicates "0", the shift/addition section 16 outputs the original MDCT coefficients without carrying out the above-described shift and addition. The shift/addition section 16 adds the MDCT coefficients shifted in the direction of the frequency axis to the original MDCT coefficients when the additional information indicates "1", and the shift/addition section 16 does not carry out shift and addition of the MDCT coefficients when the additional information indicates "0". Thus, "0" or "1" of the additional information can be detected on the side of the equipment which receives or is supplied with the audio signal outputted from the additional information embedding device. In the case where the audio signal is sampled by a frequency of 44.1 kHz and 1024 sample values as one block are MDCT-transformed to obtain MDCT coefficients, each one bit of the additional information can be embedded for every 1024 sample values. However, it should be noted that the number of sample values is not limited to 1024.

On the MDCT coefficients which are processed by predetermined processing by the shift/addition section 16, inverse modified discrete cosine transform opposite to the MDCT transform is performed at step S6. At the subsequent step S7, the audio signal is converted to an analog audio signal, and at step S8, the analog audio signal in which the additional information is embedded is outputted.

The case of demodulating the additional information embedded as a watermark in the audio signal using the codec 10 shown in FIG. 16 will now be described.

In the case where the MDCT coefficients are shifted by two or by four in the direction of the frequency axis and then added to the original MDCT coefficients by the shift/addition section 16 so as to embed the additional information as a watermark WM, the polarity of the fourth coefficients on the left and right sides of an arbitrary MDCT coefficient is inverted with a high probability by the additional information component embedded as a watermark, thus increasing/decreasing the polarity. Thus, as the fourth coefficients on the left and right side of the MDCT coefficient are accumulated with respect to the same polarity and different polarity, the bias of the polarity can be detected in a predetermined time section, for example, a section of one second.

Figure 18:
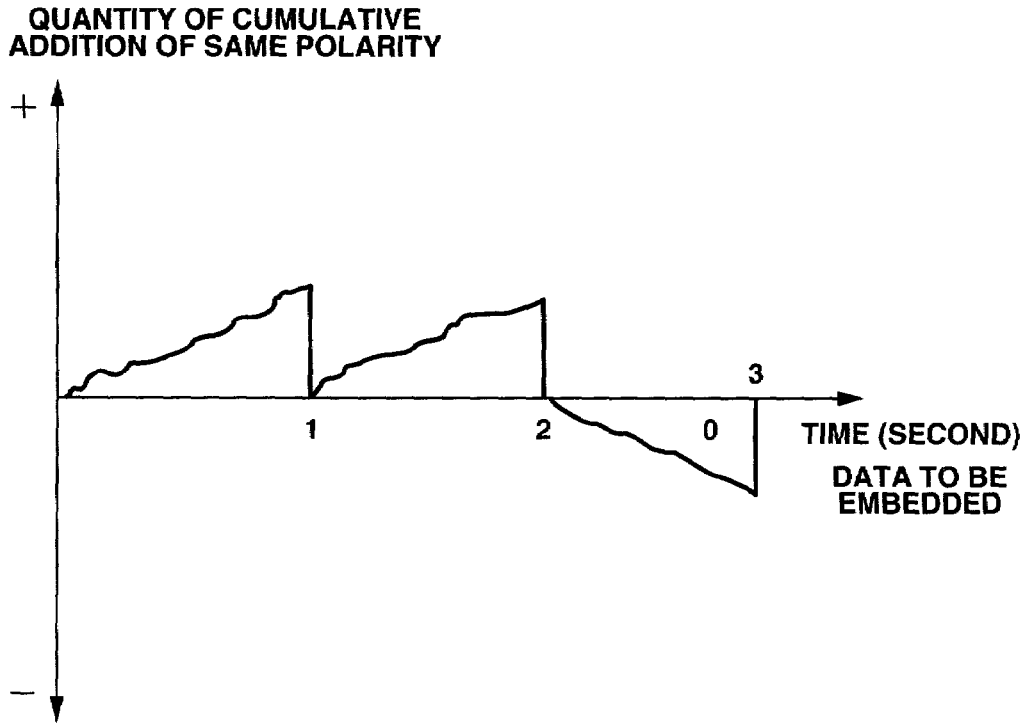
FIG. 18 is a graph showing processing for extracting the additional information in the form of a watermark embedded in the audio signal, by resetting every other second and detecting deviation of each section.
Figure 19:
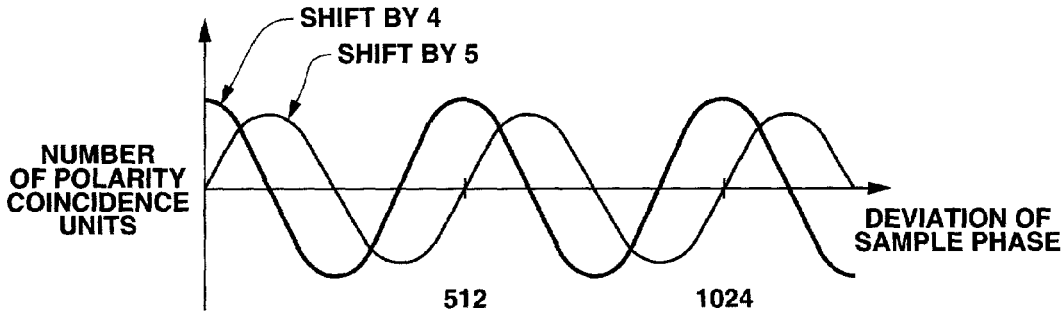
FIG. 19 is a first graph showing the operation of demodulation in accordance with the comparison of curves of different shift quantities of the MDCT coefficient in the direction of the frequency axis.

To detect the additional information embedded in the audio signal by using the bias of the polarity of the MDCT coefficients, the count number is reset every other second and the bias of the polarity in each section is examined, as shown in FIG. 18. Thus, detection of the additional information embedded as a watermark is made possible. In accordance with the combination of the case where the polarity is biased to the positive direction and the case where the polarity is biased to the negative direction, a data string of "1", "1", "0" as the data of the respective sections can be transmitted and detected, as shown in FIG. 18.

Also, in the case where the MDCT coefficients are shifted by four in the direction of the frequency axis and then added to the original MDCT coefficient so as to embed the additional information as a watermark WM, if a shift is generated in the phase of the sample values when carrying out MDCT again after the audio signal is converted to an analog signal in simply demodulating a signal such that the MDCT coefficients of the same polarity increase, the additional information sometimes cannot be read out in accordance with the combination of the positive and negative polarities.

Meanwhile, in the case where the MDCT coefficients are shifted by four in the direction of the frequency axis and then added to the original MDCT coefficient so as to embed the additional information as a watermark WM, if a shift is generated in the phase of the sample values, the number of polarity-coincident MDCT coefficients is increased or decreased in the form of a cosine wave. On the other hand, in the case where the MDCT coefficients are shifted by five in the direction of the frequency axis and then added to the original MDCT coefficient so as to embed the additional information as a watermark WM, if a shift is generated in the phase of the sample values, the number of polarity-coincident MDCT coefficients is increased or decreased in the form of a sine wave. Therefore, in the case where the 1024 sample values are MDCT-transformed as one block, if the phase of the MDCT coefficients is shifted by 128 sample values, a sufficient number of MDCT coefficient of the same polarity, of the MDCT coefficients shifted by five in the direction of the frequency axis, can be obtained even though the total number of MDCT coefficients of the same polarity, of the MDCT coefficients shifted by four in the direction of the frequency axis, is zero. Therefore, the additional information embedded as a watermark can be demodulated.

This method is an advantageous technique in the case where detection is to be carried out by a method easier than the method of copy control, or in the application where the phase of MDCT cannot be controlled.

Moreover, in synchronization processing for matching to the correct phase, since the position can be roughly specified by checking the values of 4 and 5 of the MDCT coefficients, synchronization to the correct phase can be realized without checking the phase of all the 1024 sample values. Alternatively, the phase where the maximum gain can be obtained of the 1024 sample values may be found.

Figure 20:
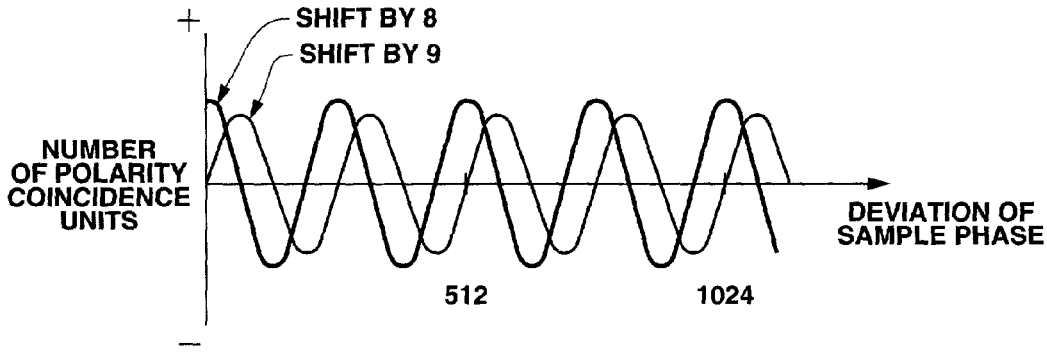
FIG. 20 is a second graph showing the operation of demodulation in accordance with the comparison of curves of different shift quantities of the MDCT coefficient in the direction of the frequency axis.

FIG. 20 shows the case where the MDCT coefficients are shifted by eight in the direction of the frequency axis and then added to the original MDCT coefficients to as to embed the additional information as a watermark WM and the case where the MDCT coefficients are shifted by nine in the direction of the frequency axis and then added to the original MDCT coefficients so as to embed the additional information as a watermark WM. The distance is changed between 8 and 9 for every 64 sample values. By combining the case where the MDCT coefficients are shifted by eight in the direction of the frequency axis and then added to the original MDCT coefficients to as to embed the additional information as a watermark WM and the case where the MDCT coefficients are shifted by nine in the direction of the frequency axis and then added to the original MDCT coefficients so as to embed the additional information as a watermark WM, rough adjustment for finding the correct phase is made easier.

Methods for providing multiple layers for this system will now be described.

In the additional information demodulation section 22, the MDCT coefficients to be the additional information are added or subtracted in the direction of the high frequencies of the original MDCT coefficients. Alternatively, in the additional information demodulation section 22, the MDCT coefficients to be the additional information are added or subtracted in the direction of the low frequencies of the original MDCT coefficients. In these methods, two types of layers which are completely independent can be utilized by setting the relation between the level of the original MDCT coefficients and the level of the added or subtracted MDCT coefficients.

Since the MDCT coefficients correspond to the frequency band, the frequency band can be limited by limitation of the MDCT coefficients, as shown in FIG. 5.

In the case where the MDCT coefficients are shifted in the direction of the frequency axis and then added to the original MDCT coefficients so as to embed the additional information, the same signal as the resultant additional information might exist in a component of the audio signal. In such case, erroneous detection of the additional information occurs.

Figure 21A:
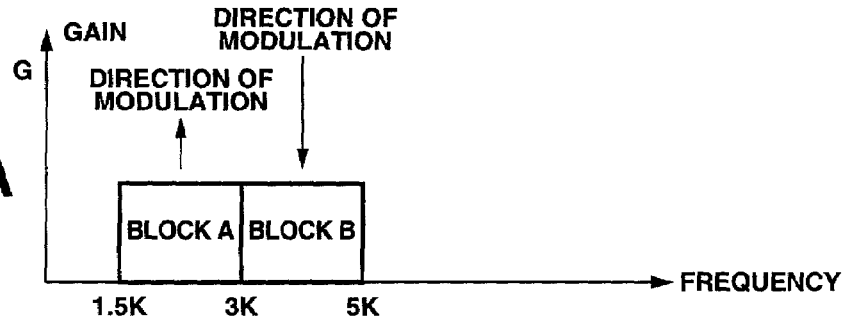
FIG. 21A is a graph showing the state of frequency band division.
Figure 21B:
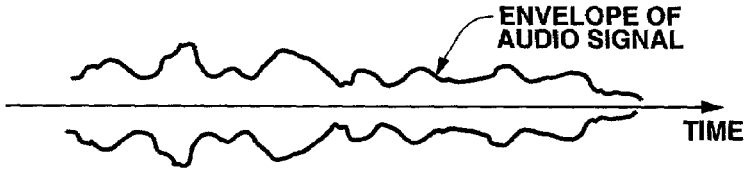
FIG. 21B is a graph showing an envelope obtained by the audio signals having the band divided in FIG. 21A are respectively modulated in the inverse phase.

The primary cause of generation of such signal component is that the envelope of the original audio signal is of the same phase as the change to be modulated, or of the inverse phase, as shown in FIG. 21B. In such case, the audio signal of each frequency band often changes with the same phase and therefore highly intensive modulation is carried out. If a large signal to overcome this is used, a problem arises in the sound quality. Thus, to easily discriminate the additional information from the original audio signal, the frequency band is divided into a block A and a block B to have opposite modulation directions, as shown in FIG. 21A. In this example, the frequency band of 1.5 to 5 kHz is divided into the blocks of 1.5 to 3 kHz and 3 to 5 kHz.

Figure 21C:
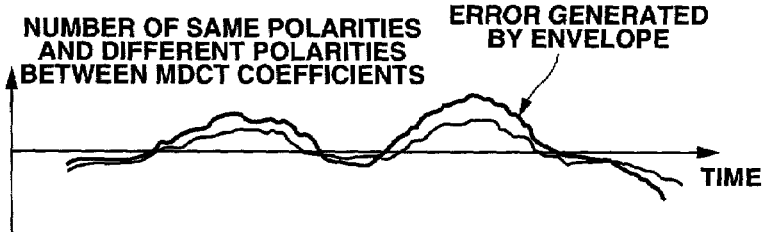
FIG. 21C is a graph showing an error generated by the envelope.
Figure 21D:
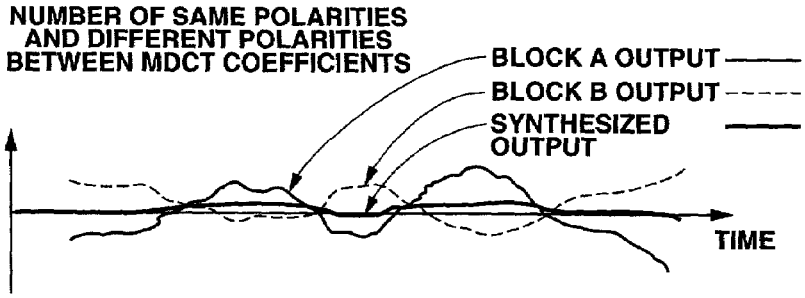
FIG. 21D is a graph showing the state of synthesis of the band-divided audio signals modulated in the inverse phase.

If these two blocks A and B of the frequency band are modulated in the same direction, the result is as shown in FIG. 21C. However, if these blocks are modulated in the opposite directions, the modulated components of the low-frequency band and the high-frequency band included in the original audio signal are demodulated as data of the opposite phases, as shown in FIG. 21D. Therefore, it is possible cancel only the error signal while maintaining the same gain of the data.

Figure 22A:
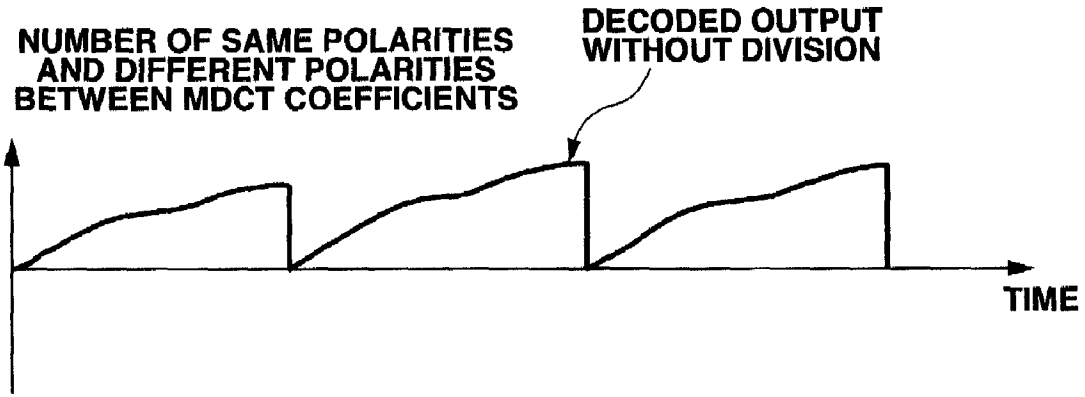
FIG. 22A is a graph showing the number of the same polarities and the number of different polarities between the MDCT coefficients in the case where frequency division is not carried out.
Figure 22B:
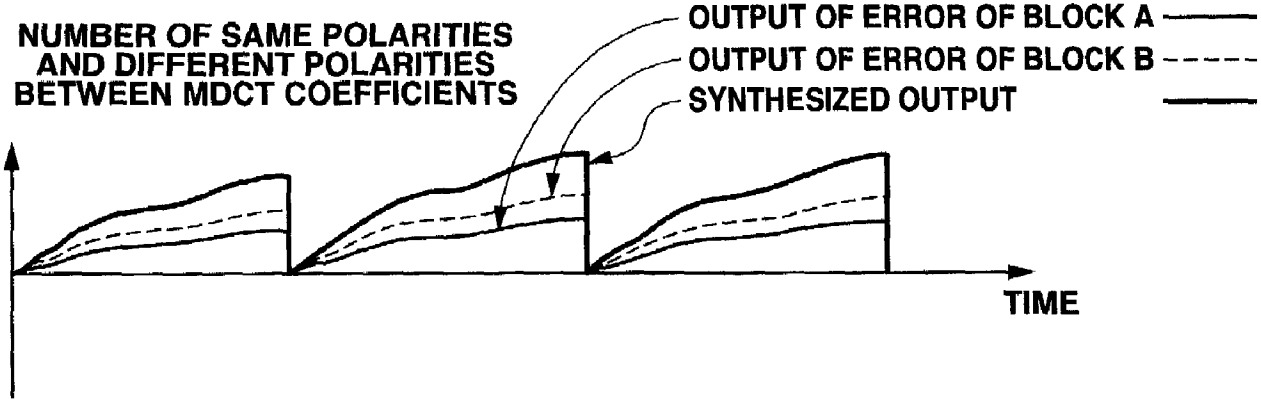
FIG. 22B is a graph showing the number of the same polarities and the number of different polarities for each block and between the synthesized MDCT coefficients in the case where frequency division is not carried out.
Figure 23A:
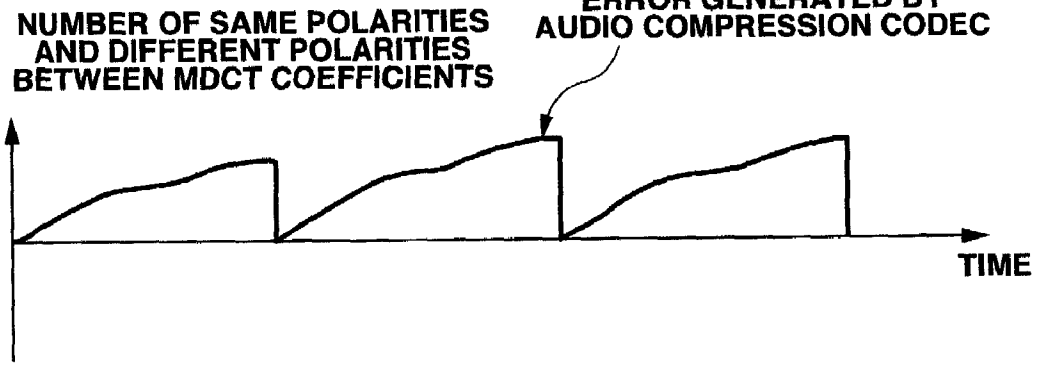
FIG. 23A is a graph showing the number of the same polarities and the number of different polarities between the MDCT coefficients in the case where frequency division is carried out.
Figure 23B:
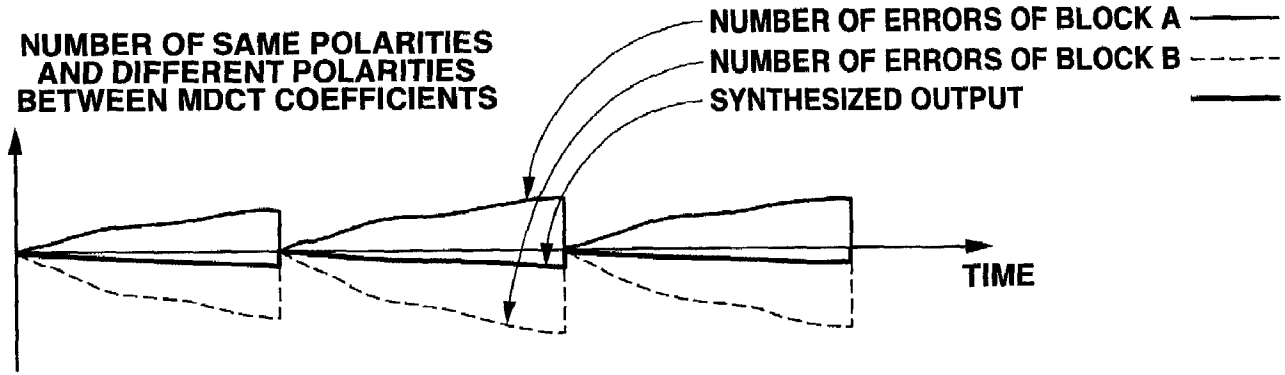
FIG. 23B is a graph showing the number of the same polarities and the number of different polarities for each block and between the synthesized MDCT coefficients in the case where frequency division is carried out.

FIGS. 22A and 22B are graphs showing the number of the same polarities and the number of different polarities between the MDCT coefficients in the case where frequency division is not carried out. FIGS. 23A and 23B are graphs showing the number of the same polarities and the number of different polarities between the MDCT coefficients in the case where frequency division is carried out. In the case where frequency division is carried out, the data rate and the error rate can be lowered by avoiding as much as possible a pattern that incidentally occurs in the audio signal.

In carrying out frequency division, selecting an octave as the frequency to be divided leads to enhancement of the cancel effect. This is due to the musical characteristics. A component including a musical interval inversely acts on the octave, it is useful for maintaining the opposite phase in terms of the probability. Alternatively, it is also effective to select approximately the same number of MDCT coefficients included in the two frequency band blocks A and B.

Also, as a method for dividing the frequency band, it is possible to subdivide the frequency band further for the cancellation method in terms of the probability, as shown in FIG. 15.

In the application to audio compression, the division characteristics of a polyphase quadrature filter (PQF) of ATRAC2 can be used for the above-described frequency division method. Also, a subband filter of the MPEG layer 3 can be utilized.

The additional information which is embedded as a watermark by shifting the MDCT coefficients in the direction of the frequency axis and the adding the resultant MDCT coefficients to the original MDCT coefficients has very high confidentiality so that it will not be separated even when conversion to analog signal or fast Fourier transform is carried out. However, such additional information can be attacked relatively easily by using MDCT. To solve this problem, detection of the additional information embedded in the audio signal using MDCT is carried out by setting the distance between the original MDCT coefficients based on the audio signal and the added MDCT coefficients shifted in the direction of the frequency axis, that is, the number of shifts, and using the polarity of these MDCT coefficients. In the case where the polarity of each MDCT coefficient for generating the additional information is inverted by a pseudo-random signal or the like, whether the signal is modulated by the additional information or not cannot be known even when a third party checks it by using MDCT.

As the pseudo-random signal used in this case, a simple PN sequence and a gold code can be used, and complicated DES and elliptic cryptography can also be used. Alternatively, an AC signal of simple repeated inversion of 1 and 0 may be used.

Also, by producing false signals from two types of cryptography such as gold codes, then fixing one and changing the other for each terminal of each individual, and changing synthesized cryptography for each terminal unit, the confidentiality of the additional information can be enhanced.

Another example of the additional information embedding device for embedding additional information as a watermark into an audio signal and the demodulation device for demodulating the additional information embedded in the audio signal will now be described.

Figure 24:
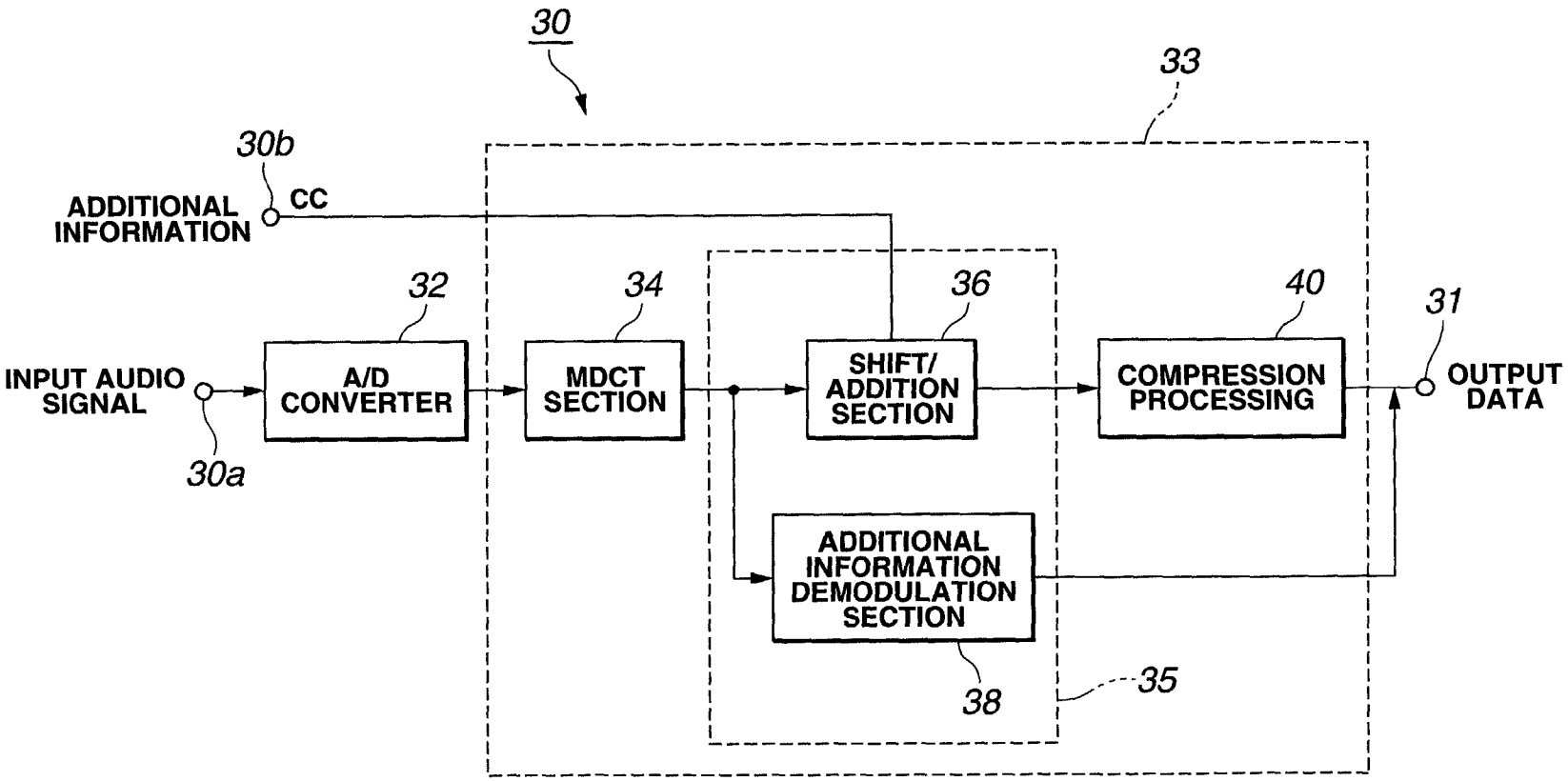
FIG. 24 is a block diagram showing another example of the codec which superimposes additional information as a watermark onto an audio signal so as to carry out modulation and then decodes the audio signal on which the additional information is superimposed.

The additional information embedding device and the additional information demodulation device in this example, too, are integrally constituted as a codec 30, as shown in FIG. 24. This codec 30 has an A/D converter 32 for converting an audio signal inputted through an audio signal input terminal 30*a* to a digital signal, and an MDCT section 34 for MDCT-transforming (modified discrete cosine transform) the audio data converted to the digital signal by the A/D converter 32. The MDCT section 34 is adapted for MDCT-transforming a PCM signal so as to output a MDCT coefficient. The MDCT section 34 carries out one-dimensional discrete cosine transform for a one-dimensional audio signal.

The codec 30 also has a shift/addition section 36 to which the MDCT coefficient calculated by the MDCT section 34 is inputted and to which additional information inputted through an additional information input terminal 30*b* is inputted. The shift/addition section 36 shifts in the direction of the frequency axis the MDCT coefficient obtained by transforming the audio signal and supplied from the MDCT section 34, and carries out polarity conversion of the original MDCT coefficient on the basis of the additional information, thus coding the MDCT coefficient and the additional information.

The signal outputted from the MDCT section 34 is inputted to an inverse MDCT section 38. The inverse MDCT section 38 carries out inverse modified discrete cosine transform, which is the opposite to the transform by the MDCT section 34, with respect to the signal outputted from the MDCT section 34.

The digital audio data in which the additional information outputted as a digital signal from the inverse MDCT section 38 is embedded is compression-coded by a compression processing circuit 40 and outputted as a compression-coded signal through an output terminal 31.

The codec 30, too, is used as the additional information demodulation device and therefore has an additional information demodulation section 38 for demodulating the additional information embedded in the audio signal from the MDCT coefficient outputted from the MDCT section 34. The additional information demodulated by the additional information demodulation section 38 is outputted to outside of the device through the output terminal 31.

The additional information embedded as a watermark into the audio signal includes limitation information for prohibiting transfer of the audio signal, limitation information for prohibiting recording of the audio signal to another recording medium, and work data corresponding to the audio signal. The work data includes data for managing the copyright of a music tune or the like corresponding to the audio signal, the copyright holder code, the copyright management number and the like.

In the codec 30 of FIG. 24, the shift/addition section 36 and the additional information demodulation section 38 are integrally constituted as a unit circuit 35. Since the shift/addition section 36 and the additional information demodulation section 38 are integrally constituted as the unit circuit 35, access from outside for unauthorized purposes is restrained. Moreover, since the MDCT section 34, the unit circuit 35 and the compression processing circuit 40 are also integrally constituted as a circuit 33, access from outside for unauthorized purposes is restrained. As the circuit 33, a circuit for executing ATRAC2 can be used. With such structure, the confidentiality of the codec 30 is improved and unauthorized access from outside to signal processing by the codec 30 is made difficult.

Figure 25:
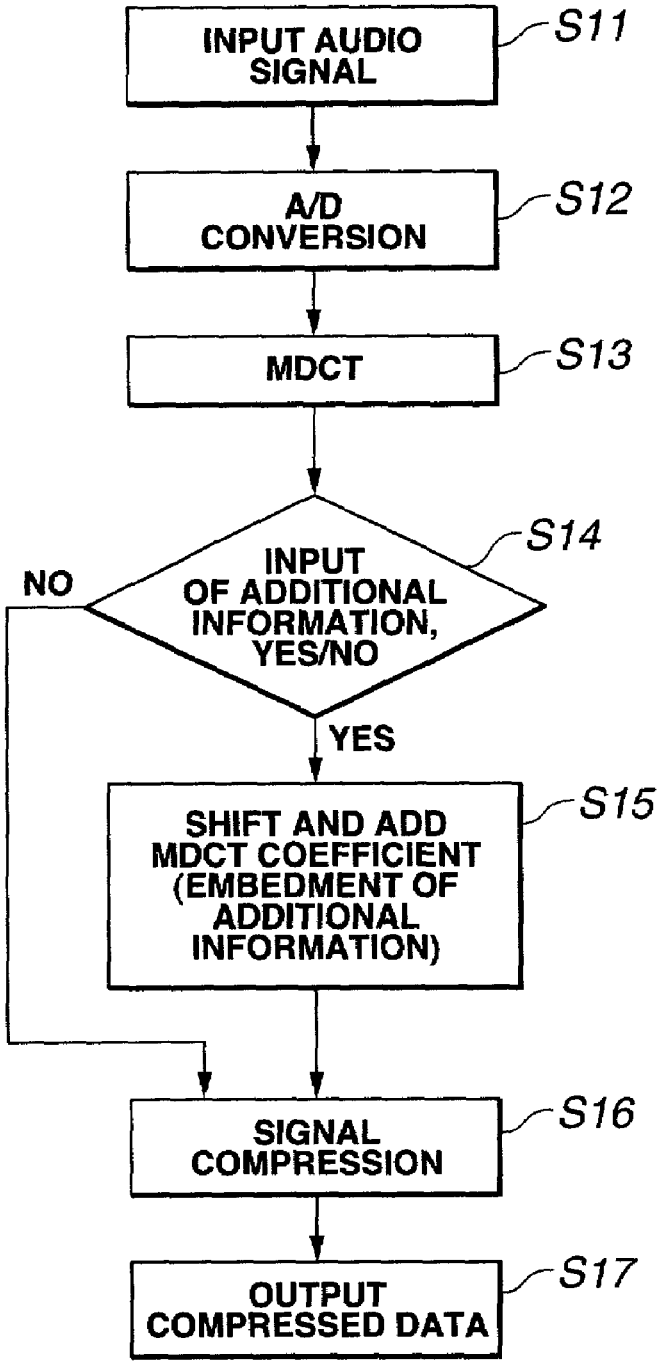
FIG. 25 is a flowchart showing the procedure for superimposing the additional information onto the audio signal by using the codec of FIG. 24.

The procedure for embedding additional information into an audio signal using the codec 30 having the additional information embedding function shown in FIG. 24 will now be described with reference to the flowchart of FIG. 25.

As an audio signal is inputted from the audio signal input terminal 30*a* at step S11, the audio signal is inputted to the A/D converter 32, where it is converted to a digital signal at step S12. The audio signal converted to the digital signal is inputted to the MDCT section 34. At step S13, the audio signal inputted to the MDCT section 34 is MDCT-transformed to calculate MDCT coefficients. The MDCT coefficients calculated by the MDCT section 34 are inputted to the shift/addition section 36.

At step S14, whether additional information is inputted to the shift/addition section 36 or not is discriminated. Specifically, when the input of the additional information indicates "1", the shift/addition section 36 at step S15 shifts the MDCT coefficients inputted from the MDCT section 34 by two or by four in the direction of the frequency axis and adds the resultant MDCT coefficients to the original MDCT coefficients, thus embedding the additional information as a watermark WM. On the other hand, when there is no input of additional information, that is, when the additional information indicates "0", the shift/addition section 36 outputs the original MDCT coefficients without carrying out the above-described shift and addition. The shift/addition section 36 adds the MDCT coefficients shifted in the direction of the frequency axis to the original MDCT coefficients when the additional information indicates "1", and the shift/addition section 36 does not carry out shift and addition of the MDCT coefficients when the additional information indicates "0". Thus, the presence or absence of the additional information can be detected on the side of the equipment which receives or is supplied with the audio signal outputted from the additional information embedding device. In the case where the audio signal is sampled by a frequency of 44.1 kHz and 1024 sample values as one block are MDCT-transformed to obtain MDCT coefficients, each one bit of the additional information can be obtained for every 1024 sample values. However, it should be noted that the number of sample values is not limited to 1024.

On the MDCT coefficients which are processed by predetermined processing by the shift/addition section 36, compression processing in accordance with the compression system of ATRAC2 is performed at step S16. At step S17, the resultant signal is outputted from the output terminal 31 as a digital audio signal in which the additional information is embedded.

The case of demodulating the additional information embedded as a watermark in the audio signal using the codec 30 shown in FIG. 24 will now be described.

In the case where the codec 30 is used as a demodulator, the analog audio signal inputted from the input terminal 30*a* is converted to a digital signal by the D/A converter 32. The MDCT section 34 MDCT-transforms the digital signal outputted from the D/A converter 32 and outputs MDCT coefficients. From the MDCT coefficients, the additional information is demodulated and outputted from the output terminal 31.

Another example of the additional information embedding device for embedding additional information as a watermark into a compressed digital audio signal and the demodulation device for demodulating the additional information embedded in the compressed digital audio signal will now be described with reference to FIG. 26. This device is useful for receiving and demodulating a digital audio signal distributed, for example, through a communication network.

Figure 26:
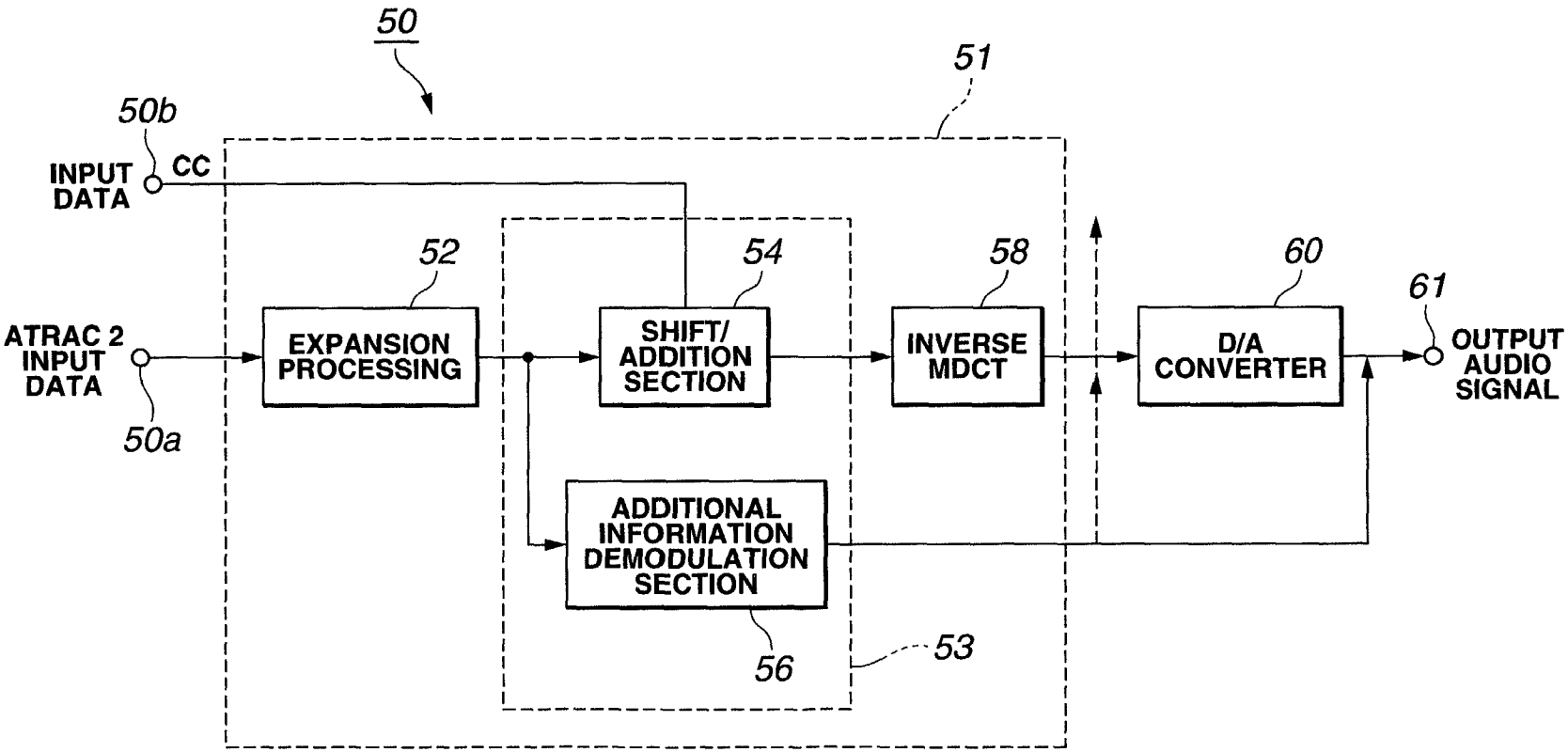
FIG. 26 is a block diagram showing still another example of the codec which superimposes additional information as a watermark onto an audio signal so as to carry out modulation and then decodes the audio signal on which the additional information is superimposed.

The additional information embedding device and the additional information demodulation device in this example, too, are integrally constituted as a codec 50, as shown in FIG. 26. This codec 30 has an expansion processing section 52 for expanding a compressed digital audio signal inputted through an input terminal 50*a* and for MDCT-transforming (modified discrete cosine transform) the expanded audio data, and a shift/addition section 54 to which the MDCT coefficient calculated by the expansion processing section 52 is inputted and to which additional information inputted through an additional information input terminal 50*b* is inputted. The shift/addition section 54 shifts in the direction of the frequency axis the MDCT coefficient obtained by transforming the audio signal and supplied from the expansion processing section 52, and carries out polarity conversion of the original MDCT coefficient on the basis of the additional information inputted from the additional information input terminal 50*b*, thus coding the MDCT coefficient and the additional information.

The signal outputted from the shift/addition section 54 is inputted to an inverse MDCT section 58. The inverse MDCT section 58 carries out inverse modified discrete cosine transform of the digital data outputted from the shift/addition section 54.

The digital audio data in which the additional information outputted from the inverse MDCT section 58 is embedded is converted to an analog audio signal by an A/D converter 60 and the outputted from an output terminal 61.

The codec 50, too, is used as the additional information demodulation device and therefore has an additional information demodulation section 56 for demodulating the additional information embedded in the audio signal from the MDCT coefficient outputted from the expansion processing section 52. The additional information demodulated by the additional information demodulation section 56 is outputted to outside of the device through the output terminal 61.

The additional information embedded as a watermark into the audio signal includes limitation information for prohibiting transfer of the audio signal, limitation information for prohibiting recording of the audio signal to another recording medium, and work data corresponding to the audio signal. The work data includes data for managing the copyright of a music tune or the like corresponding to the audio signal, the copyright holder code, the copyright management number and the like.

In the codec 50 of FIG. 26, the shift/addition section 54 and the additional information demodulation section 56 are integrally constituted as a unit circuit 53. Since the shift/addition section 54 and the additional information demodulation section 56 are integrally constituted as the unit circuit 53, access from outside for unauthorized purposes is restrained. Moreover, since the expansion processing section 52, the unit circuit 53 and the inverse MDCT section 58 are also integrally constituted as a circuit 51, access from outside for unauthorized purposes is restrained.

Meanwhile, in the case of embedding additional information as a watermark into an audio signal, as described above with reference to FIG. 6, if an envelope of an analog audio signal shown in FIG. 6B is amplitude-modulated (AM) directly by a sine wave as shown in FIG. 6C, side band signals SB can be formed on both sides of the original audio signal as shown in FIG. 6A. Since the side band signals SB function as watermarks with respect to the original audio signal, the additional information can be embedded by utilizing the side band signals SB.

Also, in the case of embedding additional information as a watermark into an audio signal, as described above with reference to FIG. 7, if an analog audio signal shown in FIG. 7B is frequency-modulated (FM) by a sine wave of a predetermined frequency as shown in FIG. 7C, side band signals SB can be formed on both sides of the original audio signal as shown in FIG. 7A. Since the side band signals SB function as watermarks with respect to the original audio signal, the additional information can be embedded by utilizing the side band signals SB.

Thus, the side band signals SB due to AM modulation and FM modulation can be generated by Hilbert conversion.

An example of generation of side band on an audio signal by Hilbert conversion will now be described with reference to FIG. 27.

A side band generation circuit 100 for generating side band signals SB on an audio signal by using Hilbert conversion includes a Hilbert converter 102 for Hilbert-converting a PCM signal as a digital audio signal inputted from an input terminal 101*a*, a modulation frequency generator 104 for generating a modulation frequency from a control signal such as frequency, gain, phase or the like inputted from an input terminal 101*b*, a real part multiplier 106 for multiplying a real part output from the Hilbert converter 102 and a real part output from the modulation frequency generator 104, an imaginary part multiplier 108 for multiplying an imaginary part output from the Hilbert converter 102 and an imaginary part output from the modulation frequency generator 104, a first adder 110 for subtracting an output of the real part multiplier 106 from an output of the imaginary part multiplier 108 so as to generate an upper side band signal SB on the high-frequency side of the PCM signal as the original audio signal, and a second adder 112 for adding the output of the real part multiplier 106 and the output of the imaginary part multiplier 108 so as to generate a lower side band signal SB on the low-frequency side of the PCM signal as the original audio signal.

By using the side band signals SB thus generated on the high-frequency side and the low-frequency side of the PCM signal as the original audio signal, the additional information can be embedded as a watermark.

Figure 28:
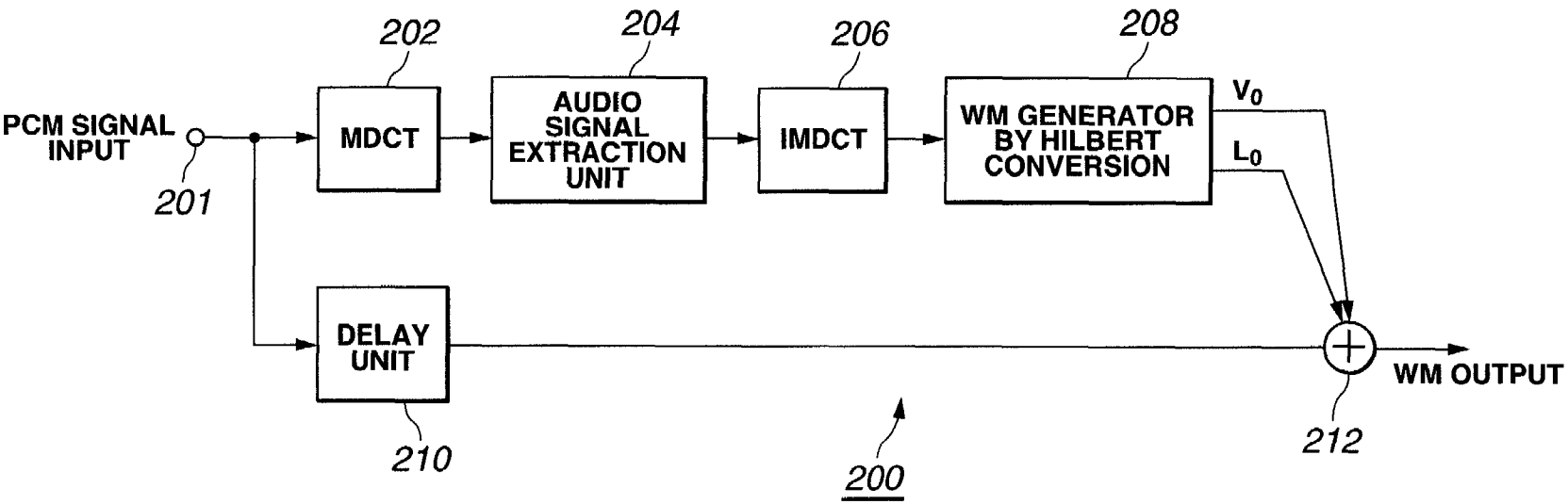
FIG. 28 is a block diagram showing embedment of additional information as a watermark into an audio signal by using the watermark generation circuit with Hilbert conversion.

FIG. 28 shows an exemplary modulation device 200 for AM-modulating or FM-modulating an original audio signal and using side band signals SB generated on both sides of the original audio signal so as to embed additional information as a watermark. The modulation device 200 has an MDCT section 202 to which a PCM signal as an original audio signal is inputted through an input terminal 201, an audio signal extraction unit 204 for extracting an audio signal of a predetermined frequency to which additional information is added, an inverse MDCT section 206, a watermark generator by Hilbert conversion 208, a timing adjustment delay unit 210, and a signal embedding circuit 212.

The MDCT section 202 carries out MDCT of an audio signal inputted as a PCM signal and thus calculates MDCT coefficients. The audio signal extraction circuit 204 extracts an audio signal of a predetermined frequency into which additional information is embedded from the MDCT coefficients. The inverse MDCT section 206 carries out inverse MDCT with respect to the PCM signal extracted by the audio signal extraction circuit 204.

Figure 27:
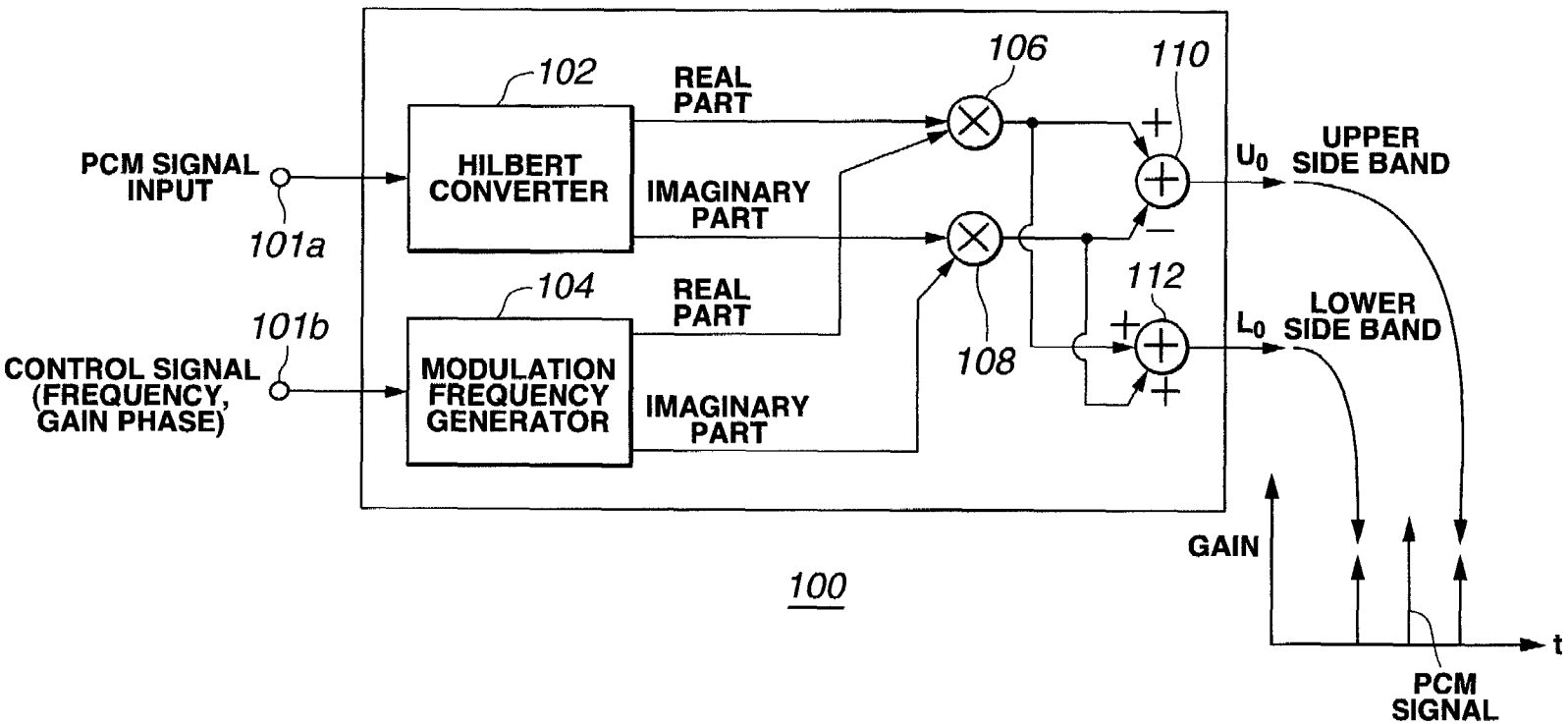
FIG. 27 is a block diagram showing a watermark generation circuit with Hilbert conversion.

The watermark generation circuit by Hilbert conversion 208 has the structure as shown in FIG. 27 and generates side band signals SB on both sides of the audio signal of the predetermined frequency in which the additional information is embedded as a watermark.

The timing adjustment delay circuit 210 delays the PCM audio signal inputted through the input terminal 201 by the time corresponding to the time of processing by the MDCT section 202, the audio signal extraction unit 204, the inverse MDCT section 206 and the watermark generator by Hilbert conversion 208, thus adjusting the timing.

The signal embedding circuit 212 embeds, as a watermark, the side band signal SB generated in the upper or lower frequency band of the audio signal where the masking effect can be obtained, into the audio signal outputted from the timing adjustment delay circuit 210.

The modulation device 200 for embedding additional information as a watermark into an audio signal by using Hilbert conversion can generate the side band signals in upper and lower frequency bands of an audio signal of an arbitrary frequency as shown in FIGS. 6A and 7A, AM modulation and FM modulation can be carried out by frequency shift through Hilbert conversion. Also, since the modulation device 200 can generate a side band signal SB in either one of upper and lower frequency bands of an audio signal of an arbitrary frequency as shown in FIG. 7A, the additional information can be embedded as a watermark at an arbitrary frequency.

INDUSTRIAL APPLICABILITY

According to the present invention, additional information is embedded by orthogonally transforming an audio signal to calculate an orthogonal transform coefficient, then damping and shifting in the direction of the frequency axis the calculated orthogonal transform coefficient, and then adding the resultant orthogonal transform coefficient to the original orthogonal transform coefficient. Therefore, the additional information can be embedded as a watermark into the audio signal. In addition, damage to the addition information embedded as a watermark can be securely prevented even in the case where the audio signal is compressed.

The invention claimed is:

1. A method for embedding additional information into an input audio signal and outputting an output audio signal having the embedded additional information, the method comprising the steps of:

orthogonally transforming the input audio signal to generate a plurality of orthogonal transform coefficients;

damping and shifting a predetermined number of orthogonal transform coefficients selected from the plurality of orthogonal transform coefficients by damping the predetermined number of orthogonal transform coefficients by a predetermined amount and shifting the predetermined number of orthogonal coefficients by a predetermined number of units in the direction of the frequency axis;

adding the damped and shifted orthogonal transform coefficients to the original orthogonal transform coefficients to form an output audio signal, the added damped and shifted orthogonal coefficients comprising the embedded additional information; and outputting the output audio signal having the embedded additional information.

2. The method as claimed in claim 1, wherein orthogonally transforming the input audio signal includes carrying out a modified discrete cosine transform (MDCT) of the audio signal to calculate MDCT coefficients, and wherein damping and shifting the predetermined number of orthogonal transform coefficients includes damping and shifting the calculated MDCT coefficients in the direction of the frequency axis and adding the damped and shifted MDCT coefficients to the original MDCT coefficients, the added damped and shifted MDCT coefficients comprising the embedded additional information.

3. The method as claimed in claim 2, wherein damping and shifting the predetermined number of orthogonal transform coefficients includes carrying out the shift and addition of the MDCT coefficients within a predetermined frequency band.

4. The method as claimed in claim 2, wherein damping and shifting the predetermined number of orthogonal transform coefficients includes shifting the MDCT coefficients toward the frequency-increasing side and adding the shifted MDCT coefficients to the original MDCT coefficients.

5. The method as claimed in claim 4, wherein damping and shifting the predetermined number of orthogonal transform coefficients includes increasing the frequency of the MDCT coefficients by ((sampling frequency/number of samples of MDCT coefficient)×2N) Hz, as the MDCT coefficients are shifted by 2N units (where N is a natural number).

6. The method as claimed in claim 5, wherein the amplitude of the MDCT coefficients is substantially equal to the amplitude of the input audio signal.

7. The method as claimed in claim 2, wherein damping and shifting the predetermined number of orthogonal transform coefficients includes shifting the MDCT coefficients toward the frequency-decreasing side and adding the shifted MDCT coefficients to the original MDCT coefficients.

8. The method as claimed in claim 7, wherein damping and shifting the predetermined number of orthogonal transform coefficients includes decreasing the frequency of the MDCT coefficients by ((sampling frequency/number of samples of MDCT coefficient)×2N) Hz, as the MDCT coefficients is shifted by 2N units (where N is a natural number).

9. The method as claimed in claim 8, wherein the amplitude of the MDCT coefficients is substantially equal to the amplitude of the input audio signal.

10. The method as claimed in claim 2, wherein damping and shifting the predetermined number of orthogonal transform coefficients includes shifting the MDCT coefficients by 2N units (where N is a natural number).

11. The method as claimed in claim 2, wherein damping and shifting the predetermined number of orthogonal transform coefficients includes shifting the MDCT coefficient by 2N−1 units (where N is a natural number).

12. The method as claimed in claim 2, wherein damping and shifting the predetermined number of orthogonal transform coefficients includes adding the shifted MDCT coefficients within a critical band of a frequency masking area of the MDCT coefficients of the original input audio signal.

13. The method as claimed in claim 1, wherein damping and shifting the predetermined number of orthogonal transform coefficients includes adding the orthogonal transform coefficients shifted on the frequency axis to the original orthogonal transform coefficients so that a frequency masking condition and a temporal masking condition are met.

14. The method as claimed in claim 1, wherein damping and shifting the predetermined number of orthogonal transform coefficients includes carrying out the addition when the value obtained by adding the shifted orthogonal transform coefficients to the value of the original orthogonal transform coefficients is not higher than a predetermined value.

15. The method as claimed in claim 1, wherein damping and shifting the predetermined number of orthogonal transform coefficients includes prohibiting the shift and addition in accordance with the polarity of the value obtained by adding the shifted orthogonal transform coefficients to the value of the original orthogonal transform coefficients.

16. The method as claimed in claim 1, wherein damping and shifting the predetermined number of orthogonal transform coefficients includes carrying out the shift and addition when the input audio signal falls within a range from an upper limit value to a lower limit value.

17. The method as claimed in claim 16, wherein damping and shifting the predetermined number of orthogonal transform coefficients includes carrying out the shift and addition when the input audio signal falls within a range from an upper limit value to a lower limit value set on the basis of the human auditory characteristics.

18. The method as claimed in claim 1, wherein damping and shifting the predetermined number of orthogonal transform coefficients includes carrying out the shift and addition of the orthogonal transform coefficients within a predetermined frequency band.

19. The method as claimed in claim 1, wherein damping and shifting the predetermined number of orthogonal transform coefficients includes dividing the frequency band of the input audio signal and carrying out shift and addition for each of the divided frequency bands.

20. The method as claimed in claim 19, wherein damping and shifting the predetermined number of orthogonal transform coefficients includes reversing the shifting direction of the divided adjacent frequency bands.

21. The method as claimed in claim 1, further comprising scrambling the output audio signal using a pseudo-random signal.

22. The method as claimed in claim 1, wherein the embedded additional information comprises limitation information for prohibiting the transfer of the input audio signal.

23. The method as claimed in claim 1, wherein the embedded additional information comprises limitation information for prohibiting recording of the input audio signal to a recording medium.

24. The method as claimed in claim 1, wherein the embedded additional information comprises work data corresponding to the input audio signal.

25. A device for embedding additional information into an input audio signal and outputting an output audio signal having the embedded additional information, the device comprising:

orthogonal transform means for orthogonally transforming the input audio signal to generate a plurality of orthogonal transform coefficients;

shift and addition means for damping and shifting a predetermined number of orthogonal transform coefficients selected from said plurality of orthogonal transform coefficients by damping the predetermined number of orthogonal transform coefficients by a predetermined amount and shifting the predetermined number of orthogonal coefficients by a predetermined number of units in the direction of the frequency axis and adding the damped and shifted orthogonal transform coefficients to the original orthogonal transform coefficients to form the output audio signal, the added damped and shifted orthogonal coefficients comprising the embedded additional information; and output means for outputting the output audio signal having embedded additional information.

26. The device as claimed in claim 25, wherein the orthogonal transform means carries out a modified discrete cosine transform (MDCT) of the audio signal to calculate MDCT coefficients, and wherein the shift and addition means damps and shifts the calculated MDCT coefficients in the direction of the frequency axis and adds the damped and shifted MDCT coefficients to the original MDCT coefficients, the added damped and shifted MDCT coefficients comprising the embedded additional information.

27. The device as claimed in claim 26, wherein the shift and addition means carries out the shift and addition of the MDCT coefficients within a predetermined frequency band.

28. The device as claimed in claim 26, wherein the shift and addition means shifts the MDCT coefficients toward the frequency-increasing side and adds the shifted MDCT coefficients to the original MDCT coefficients.

29. The device as claimed in claim 28, wherein at the shift and addition means, the frequency of the MDCT coefficients is increased by ((sampling frequency/number of samples of MDCT coefficient)×2N) Hz, as the MDCT coefficients are shifted by 2N units (where N is a natural number).

30. The device as claimed in claim 29, wherein at the shift and addition means, the amplitude of the MDCT coefficients is substantially equal to the amplitude of the input audio signal.

31. The device as claimed in claim 26, wherein the shift and addition means shifts the MDCT coefficients toward the frequency-decreasing side and adds the shifted MDCT coefficients to the original MDCT coefficients.

32. The device as claimed in claim 31, wherein at the shift and addition means, the frequency of the MDCT coefficients is decreased by ((sampling frequency/number of samples of MDCT coefficient)×2N) Hz, as the MDCT coefficients is shifted by 2N units (where N is a natural number).

33. The device as claimed in claim 32, wherein at the shift and addition means, the amplitude of the MDCT coefficients is substantially equal to the amplitude of the input audio signal.

34. The device as claimed in claim 26, wherein the shift and addition means shifts the MDCT coefficients by 2N units (where N is a natural number).

35. The device as claimed in claim 26, wherein the shift and addition means shifts the MDCT coefficients by 2N−1 units (where N is a natural number).

36. The device as claimed in claim 26, wherein the shift and addition means adds the shifted MDCT coefficients within a critical band of a frequency masking area of the MDCT coefficients of the original input audio signal.

37. The device as claimed in claim 25, wherein the shift and addition means adds the orthogonal transform coefficients shifted on the frequency axis to the original orthogonal transform coefficients so that a frequency masking condition and a temporal masking condition are met.

38. The device as claimed in claim 25, wherein the shift and addition means carries out the addition when the value obtained by adding the shifted orthogonal transform coefficients to the value of the original orthogonal transform coefficients is not higher than a predetermined value.

39. The device as claimed in claim 25, wherein the shift and addition means prohibits the shift and addition in accordance with the polarity of the value obtained by adding the shifted orthogonal transform coefficients to the value of the original orthogonal transform coefficients.

40. The device as claimed in claim 25, wherein the shift and addition means carries out the shift and addition when the input audio signal falls within a range from an upper limit value to a lower limit value.

41. The device as claimed in claim 40, wherein the shift and addition means carries out the shift and addition when the input audio signal falls within a range from an upper limit value to a lower limit value set on the basis of the human auditory characteristics.

42. The device as claimed in claim 25, wherein the shift and addition means carries out the shift and addition of the orthogonal transform coefficients within a predetermined frequency band.

43. The device as claimed in claim 25, wherein the shift and addition means divides the frequency band of the input audio signal and carries out shift and addition for each of the divided frequency bands.

44. The device as claimed in claim 43, wherein the shift and addition means reverses the shifting direction of the divided adjacent frequency bands.

45. The device as claimed in claim 25, further comprising means for scrambling the output audio signal using a pseudo-random signal.

46. The device as claimed in claim 25, wherein the orthogonal transform means and the shift and addition means are integrally formed in a single circuit.

47. The device as claimed in claim 25, wherein the embedded additional information comprises limitation information for prohibiting transfer of the input audio signal.

48. The device as claimed in claim 25, wherein the embedded additional information is limitation information for prohibiting recording of the input audio signal to a recording medium.

49. The device as claimed in claim 25, wherein the embedded additional information is work data corresponding to the input audio signal.

50. A method for demodulating embedded additional information in a received audio signal, the embedded additional information generated by performing an inverse orthogonal transform on a predetermined number of a plurality of orthogonal transform coefficients generated by orthogonally transforming the audio signal, the method comprising the steps of:

receiving the audio signal having embedded additional information, the additional information embedded by damping and shifting a predetermined number of orthogonal transform coefficients selected from the plurality of orthogonal transform coefficients by damping the predetermined number of orthogonal transform coefficients by a predetermined amount and shifting the predetermined number of orthogonal coefficients by a predetermined number of units in the direction of the frequency axis and adding the damped and shifted orthogonal transform coefficients to the audio signal on the original frequency axis;

demodulation step of demodulating the embedded additional information on the basis of the polarity of the received audio signal at predetermined intervals on the frequency axis; and outputting the demodulated embedded additional information.

51. The method as claimed in claim 50, wherein the step of receiving the audio signal includes receiving the audio signal having embedded additional information, the additional information embedded by damping and shifting in the direction of the frequency axis modified discrete cosine transform (MDCT) coefficient calculated by performing an MDCT on the audio signal and adding the damped and shifted MDCT coefficient to the original MDCT coefficient.

52. The method as claimed in claim 50, wherein the step of receiving the audio signal includes receiving the audio signal having embedded additional information, the additional information embedded by AM modulation, and wherein the demodulation step includes demodulating the embedded additional information on the basis of the polarity of the received audio signal at predetermined intervals on the frequency axis.

53. The method as claimed in claim 50, wherein the step of receiving the audio signal includes receiving the audio signal having embedded additional information by FM modulation, and wherein the demodulation step includes demodulating the embedded additional information on the basis of the polarity of the received audio signal at predetermined intervals on the frequency axis.

54. The method as claimed in claim 50, wherein the step of receiving the audio signal includes receiving the audio signal having embedded additional information by Hilbert conversion, and wherein the demodulation step includes demodulating the embedded additional information on the basis of the polarity of the received audio signal at predetermined intervals on the frequency axis.

55. The method as claimed in claim 50, wherein the step of demodulating includes demodulating the embedded additional information on the basis of the polarity of the received audio signal at predetermined intervals on the frequency axis within a predetermined frequency band.

56. The method as claimed in claim 50, wherein the embedded additional information comprises control information for prohibiting transfer of the received audio signal.

57. The method as claimed in claim 50, wherein the embedded additional information comprises control information for prohibiting recording of the received audio signal to a recording medium.

58. The method as claimed in claim 50, wherein the embedded additional information comprises work data corresponding to the received audio signal.

59. A device for demodulating embedded additional information in a received audio signal the embedded additional information generated by performing an inverse orthogonal transform on a predetermined number of orthogonal transform coefficients generated by orthogonally transforming the audio signal the device comprising:

receiving means for receiving the audio signal having embedded additional information, the additional information embedded by damping and shifting a predetermined number of orthogonal transform coefficients selected from the plurality of orthogonal transform coefficients by damping the predetermined number of orthogonal transform coefficients by a predetermined amount and shifting the predetermined number of orthogonal coefficients by a predetermined number of units in the direction of the frequency axis and adding the damped and shifted orthogonal transform coefficients to the audio signal on the original frequency axis;

demodulation means for demodulating the embedded additional information on the basis of the polarity of the received audio signal at predetermined intervals on the frequency axis; and an outputting means for outputting the demodulated embedded additional information.

60. The device as claimed in claim 59, wherein the receiving means receives the audio signal having embedded additional information, the embedded additional information embedded by damping and shifting in the direction of the frequency axis a modified discrete cosine transform (MDCT) coefficient calculated by performing an MDCT on the audio signal and adding the damped and shifted MDCT coefficient to the original MDCT coefficient.

61. The device as claimed in claim 59, wherein the receiving means receives receiving the audio signal having embedded information, the additional information embedded by AM modulation, and wherein the demodulation means demodulates the embedded additional information on the basis of the polarity of the received audio signal at predetermined intervals on the frequency axis.

62. The device as claimed in claim 59, wherein the receiving means receives the audio signal having embedded additional information embedded by FM modulation, and wherein the demodulation means demodulates the embedded additional information on the basis of the polarity of the received audio signal at predetermined intervals on the frequency axis.

63. The device as claimed in claim 59, wherein the receiving means receives the audio signal having embedded additional information embedded by Hilbert conversion, and wherein the demodulation means demodulates the embedded additional information the basis of the polarity of the received audio signal at predetermined intervals on the frequency axis.

64. The device as claimed in claim 59, wherein the demodulation means demodulates the embedded additional information on the basis of the polarity of the received audio signal at predetermined intervals on the frequency axis within a predetermined frequency band of the received audio signal.

65. The device as claimed in claim 59, wherein the embedded additional information comprises control information for prohibiting transfer of the received audio signal.

66. The method as claimed in claim 59, wherein the embedded additional information comprises control information for prohibiting recording of the received audio signal to a recording medium.

67. The method as claimed in claim 59, wherein the embedded additional information comprises work data corresponding to the received audio signal.

* * * * *